US008214947B1

(12) United States Patent
Helton

(10) Patent No.: US 8,214,947 B1
(45) Date of Patent: Jul. 10, 2012

(54) BEDCLOTHES APPARATUS

(76) Inventor: Gail L. Helton, Mesa, AZ (US)

( * ) Notice: Subject to any disclaimer, the term of this patent is extended or adjusted under 35 U.S.C. 154(b) by 0 days.

(21) Appl. No.: 13/371,968

(22) Filed: Feb. 13, 2012

Related U.S. Application Data

(63) Continuation-in-part of application No. 13/118,022, filed on May 27, 2011, now Pat. No. 8,117,693, which is a continuation of application No. 12/612,024, filed on Nov. 4, 2009, now Pat. No. 7,971,293.

(60) Provisional application No. 61/205,519, filed on Jan. 20, 2009.

(51) Int. Cl.
*A47G 9/04* (2006.01)

(52) U.S. Cl. ..... 5/486; 5/482; 5/502

(58) Field of Classification Search ..... 5/486, 482, 5/494, 496–500, 502
See application file for complete search history.

(56) References Cited

U.S. PATENT DOCUMENTS

| | | | | |
|---|---|---|---|---|
| 2,689,961 | A | 8/1952 | Lieberthal | |
| 3,072,776 | A | 1/1963 | Quenneville | |
| 3,331,088 | A | 7/1967 | Marquette | |
| 3,530,516 | A | 9/1970 | Marquette | |
| 4,069,526 | A | 1/1978 | Deikel | |
| 4,172,300 | A | 10/1979 | Miller | |
| 4,573,227 | A | 3/1986 | Prandina | |
| 5,287,573 | A | 2/1994 | Ritacco | |
| 6,226,814 | B1 | 5/2001 | Alexander | |
| 6,311,347 | B1 | 11/2001 | Limardi et al. | |
| 6,389,621 | B1 | 5/2002 | Elliott et al. | |
| 6,698,043 | B2 | 3/2004 | Fabian | |
| 6,862,760 | B2 | 3/2005 | Bradley et al. | |
| 7,100,223 | B1 | 9/2006 | Anthony | |
| 7,971,293 | B1 | 7/2011 | Helton | |
| 8,117,693 | B1 * | 2/2012 | Helton | 5/486 |
| 2011/0252563 | A1 * | 10/2011 | Horstman | 5/486 |

* cited by examiner

*Primary Examiner* — Robert G Santos
(74) *Attorney, Agent, or Firm* — Parsons & Goltry; Michael W. Goltry; Robert A. Parsons

(57) ABSTRACT

A bedclothes apparatus includes a blanket sized to cover two occupants of a bed, first and second coverlets, a first fastener assembly operable to secure the first coverlet to a central section of the blanket to allow the first coverlet to be laid across a first segment of the blanket and to release the first coverlet from the central section of the blanket to allow the first coverlet to be moved away from the first segment and the central section of the blanket, and a second fastener assembly operable to secure the second coverlet to the central section of the blanket to allow the second coverlet to be laid across a second segment of the blanket and to release the second coverlet from the central section of the blanket to allow the second coverlet to be moved away from the second segment and the central section of the blanket.

14 Claims, 16 Drawing Sheets

BEDCLOTHES APPARATUS

FIELD OF THE INVENTION

The present invention relates to bedding.

BACKGROUND OF THE INVENTION

Bedding or bedclothes refers to the customary coverings for a bed, such as sheets and blankets. A sheet is a large piece of cloth used to cover a mattress. This sheet is often referred to as a "bottom sheet," and it is this sheet that one typically lies on. In many areas of the world, a second flat bed sheet is laid on top of the sheet covering the mattress. This is known as the "top sheet." One sleeps between the bottom sheet and the top sheet. A comforter, quilt, duvet and other like blanket is then placed on top of the top sheet for warmth. The problem with conventional blankets is that then when two people are sharing the same bed one person may get hot during the night and not require the blanket, while the other person may tend to get cold and wish to use the blanket throughout the night. In the occasions when this occurs, it is often a struggle for the person who is hot to rid or partially rid himself of the blanket without disturbing the entire blanket and possibly disturbing or waking the other person.

SUMMARY OF THE INVENTION

According to the principle of the invention, a bedclothes apparatus includes first and second blankets each sized to cover two occupants of a bed. The first blanket has a first central section and opposed first and second segments formed on either side of the first central section. The second blanket has a second central section, and the second blanket is, according to the principle of the invention, partially severed along the second central section to form a first coverlet having a first marginal edge and an opposed second coverlet having a second marginal edge opposing the first marginal edge. The first coverlet of the second blanket is substantially coextensive with respect to the first segment of the first blanket, and the second coverlet of the second blanket is substantially coextensive with respect to the second segment of the first blanket. A first fastener assembly is formed between the first marginal edge of first coverlet of the second blanket and the first central section of the first blanket to releasably connect the first marginal edge of the first coverlet of the second blanket to the first central section of the first blanket. A second fastener assembly is formed between the second marginal edge of the second coverlet of the second blanket and the first central section of the first blanket to releasably connect the second marginal edge of the second coverlet of the second blanket to the first central section of the first blanket. The first fastener assembly is operable independently of the second fastener assembly to secure the first marginal edge of the first coverlet to and along the first central section of the first blanket to allow the first coverlet to be laid across the first segment of the first blanket, and to release the first marginal edge of the first coverlet from the first central section of the first blanket to allow the first coverlet to be moved away from the first segment of the first blanket and the first central section of the first blanket. The second fastener assembly is operable independently of the first fastener assembly to secure the second marginal edge of the second coverlet to and along the first central section of the first blanket to allow the second coverlet to be laid across the second segment of the first blanket, and to release the second marginal edge of the second coverlet from the first central section of the first blanket to allow the second coverlet to be moved away from the second segment of the first blanket and the first central section of the first blanket. The first fastener assembly is preferably a first slide fastener assembly, and the second fastener assembly is preferably a second slide fastener assembly. In a particular embodiment, the first blanket is a fitted sheet.

According to the principle of the invention, a bedclothes apparatus includes first and second blankets each sized to cover two occupants of a bed. The first blanket has opposed first and second ends, opposed first and second sides, and a first central section between the opposed first and second sides extending from the first end of the first blanket to the second end of the first blanket forming a first segment of the first blanket on one side of the first central section extending from the first central section to the first side of the first blanket and between the first and second ends of the first blanket, and a second segment of the first blanket on an the opposing side of the first central section extending from the first central section to the second side of the first blanket and between the first and second ends of the first blanket. The second blanket has opposed third and fourth ends, opposed third and fourth sides, and a second central section between the opposed third and fourth sides extending from the third end of the second blanket to fourth end of the second blanket. The second blanket is partially severed along the second central section from the third end of the second blanket to a point just inboard of the fourth end of the second blanket leaving the second blanket connected along the fourth end of the second blanket while forming opposed, parallel first and second marginal edges in the second blanket and a gap therebetween and further forming a first coverlet of the second blanket extending from the first marginal edge on one side of the gap to the third side of the second blanket and between the third and fourth ends of the second blanket, and a second coverlet of the second blanket extending from the second marginal edge the opposing side of the gap to the fourth side of the second blanket and between the third and fourth ends of the second blanket, according to the principle of the invention. The first coverlet of the second blanket is substantially coextensive with respect to the first segment of the first blanket, and the second coverlet of the second blanket is substantially coextensive with respect to the second segment of the first blanket. A first fastener assembly is formed between the first marginal edge of first coverlet of the second blanket and the first central section of the first blanket to releasably connect the first marginal edge of the first coverlet of the second blanket to the first central section of the first blanket. A second fastener assembly is formed between the second marginal edge of the second coverlet of the second blanket and the first central section of the first blanket to releasably connect the second marginal edge of the second coverlet of the second blanket to the first central section of the first blanket. The first fastener assembly is operable independently of the second fastener assembly to secure the first marginal edge of the first coverlet to and along the first central section of the first blanket to allow the first coverlet to be laid across the first segment of the first blanket, and to release the first marginal edge of the first coverlet from the first central section of the first blanket to allow the first coverlet to be moved away from the first segment of the first blanket and the first central section of the first blanket. The second fastener assembly is operable independently of the first fastener assembly to secure the second marginal edge of the second coverlet to and along the first central section of the first blanket to allow the second coverlet to be laid across the second segment of the first blanket, and to release the second marginal edge of the second coverlet from the first central section of the first blanket to allow the second coverlet to be moved away from the second segment of the first blanket and the first central section of the first blanket. The first fastener assembly is preferably a first slide fastener assembly, and the second fastener assembly is preferably a second slide fastener assembly. In a particular embodiment, the first blanket is a fitted sheet.

According to the principle of the invention, a bedclothes apparatus includes a blanket sized to cover two occupants of a bed. The blanket has a central section and opposed first and second segments formed on either side of the central section. The first and second segments have opposed first and second upper sections, respectively, and opposed first and second lower sections, respectively, and the central section extends along the first and second upper sections and the first and second lower sections of the respective first and second segments of the blanket. A first coverlet is substantially coextensive with respect to the first segment of the blanket and has opposed first and second ends and a first marginal edge extending therebetween, and a second coverlet is substantially coextensive with respect to the second segment of the blanket and has opposed third and fourth ends and a second marginal edge extending therebetween. A first fastener assembly is formed between the central section of the blanket and the first marginal edge of first coverlet to releasably connect the first marginal edge of the first coverlet, from the first end of the first coverlet to the second end of the first coverlet, to the central section of the blanket. A second fastener assembly is formed between the central section of the blanket and the second marginal edge of the second coverlet to releasably connect the second marginal edge of the second coverlet, from the third end of the second coverlet to the fourth end of the second coverlet, to the central section of the blanket. The first fastener assembly is operable independently of the second fastener assembly to secure the first marginal edge of the first coverlet to and along the central section of the blanket to allow the first coverlet to be laid across the first segment of the blanket, to release the first marginal edge of the first coverlet from the central section of the blanket extending along the first upper section of the first segment of the blanket to allow the first coverlet to be moved away from the first upper section of the first segment of the blanket and the central section of the blanket extending along the first upper section of the first segment of the blanket while leaving the first marginal edge of the first coverlet secured to the central section of the blanket extending along the first lower section of the first segment of the blanket, to release the first marginal edge of the first coverlet from the central section of the blanket along the first lower section of the first segment of the blanket to allow the first coverlet to be moved away from the first lower section of the first segment of the blanket and the central section of the blanket extending along the first lower section of the first segment of the blanket while leaving the first marginal edge of the first coverlet secured to the central section of the blanket extending along the first upper section of the first segment of the blanket, and to release the first marginal edge of the first coverlet from the central section of the blanket to detach the first coverlet from the blanket. The second fastener assembly is operable independently of the first fastener assembly to secure the second marginal edge of the second coverlet to and along the central section of the blanket to allow the second coverlet to be laid across the second segment of the blanket, to release the second marginal edge of the second coverlet from the central section of the blanket extending along the second upper section of the second segment of the blanket to allow the second coverlet to be moved away from the second upper section of the second segment of the blanket and the central section of the blanket extending along the second upper section of the second segment of the blanket while leaving the second marginal edge of the second coverlet secured to the central section of the blanket extending along the second lower section of the second segment of the blanket, to release the second marginal edge of the second coverlet from the central section of the blanket along the second lower section of the second segment of the blanket to allow the second coverlet to be moved away from the second lower section of the second segment of the blanket and the central section of the blanket extending along the second lower section of the second segment of the blanket while leaving the second marginal edge of the second coverlet secured to the central section of the blanket extending along the second upper section of the second segment of the blanket, and to release the second marginal edge of the second coverlet from the central section of the blanket to detach the second coverlet from the blanket. The first fastener assembly is preferably a first slide fastener assembly, and he second fastener assembly is preferably a second slide fastener assembly. In a particular embodiment, the first blanket is a fitted sheet.

According to the principle of the invention, a bedclothes apparatus includes a blanket sized to cover two occupants of a bed. The blanket has a central section and opposed first and second segments formed on either side of the central section. The first and second segments have opposed first and second upper sections, respectively, and opposed first and second lower sections, respectively, and the central section extends along the first and second upper sections and the first and second lower sections of the first and second segments, respectively, of the blanket. A first coverlet has a first marginal edge. A first slide fastener assembly, incorporating opposed first and second sliders, is formed between the central section of the blanket and the first marginal edge of the first coverlet. The first slide fastener assembly is operable to secure the first marginal edge of the first coverlet to and along the central section of the blanket in a first secured condition of the first coverlet to allow the first coverlet to be laid across the first segment of the blanket, to release the first marginal edge of the first coverlet from the central section of the blanket in response to movement of the first slider in a direction from the first upper section of the first segment of the blanket toward the first lower section of the first segment of the blanket extending along the first upper section of the first segment of the blanket to allow the first coverlet to be moved away from the first upper section of the first segment of the blanket and the central section of the blanket extending along the first upper section of the first segment of the blanket while leaving the first marginal edge of the first coverlet secured to the central section of the blanket extending along the first lower section of the first segment of the blanket, and to release the first marginal edge of the first coverlet from the central section of the blanket in response to movement of the second slider in a direction from the first lower section of the first segment of the blanket toward the first upper section of the first segment of the blanket extending along the first lower section of the first segment of the blanket to allow the first coverlet to be moved away from the first lower section of the first segment of the blanket and the central section of the blanket extending along the first lower section of the first segment of the blanket while leaving the first marginal edge of the first coverlet secured to the central section of the blanket extending along the first upper section of the first segment of the blanket. A second coverlet has a second marginal edge. A second slide fastener assembly, incorporating opposed third and fourth sliders, is formed between the central section of the blanket and the second marginal edge of the second coverlet. The second slide fastener assembly is operable to secure the second marginal edge of the second coverlet to and along the central section of the blanket in a second secured condition of the second coverlet to allow the second coverlet to be laid across the first segment of the blanket and the first coverlet in the first secured condition of the first coverlet laid across the first segment of the blanket, to release the second marginal edge of the second coverlet from the central section of the blanket in response to movement of the third slider in a direction from the first upper section of the first segment of the blanket toward the first lower section of the first segment of the blanket extending along the first upper section of the first segment of the blanket to allow the second coverlet to be moved away from the first upper section of the first segment of the blanket and the central section of the blanket extending along the first upper section of the first segment of the blanket while leaving the second marginal edge of the second coverlet secured to the central section of the blanket extending along the first lower section of the first segment of the blanket, and to release the second marginal edge of the second coverlet from the central section of the blanket in response to movement of the fourth slider in a direction from the first lower section of the first segment of the blanket toward the first upper section of the first segment of the blanket extending along the first lower section of the first segment of the blanket to allow the second coverlet to be moved away from the first lower section of the first segment of the blanket and the central section of the blanket extending along the first lower section of the first segment of the blanket while leaving the second marginal edge of the second coverlet secured to the central section of the blanket extending along the first upper section of the first segment of the blanket. The first coverlet has a first warmth characteristic, and the second coverlet has a second warmth characteristic different from the first warmth characteristic of the first coverlet. In a further embodiment, there is also a third coverlet having a third marginal edge. A third slide fastener assembly, incorporating opposed fifth and sixth sliders, is formed between the central section of the blanket and the third marginal edge of the third coverlet to releasably connect the third marginal edge of the third coverlet to the central section of the blanket. The third slide fastener assembly is operable to secure the third marginal edge of the third coverlet to and along the central section of the blanket in a third secured condition of the third coverlet to allow the third coverlet to be laid across the second segment of the blanket, to release the third marginal edge of the third coverlet from the central section of the blanket in response to movement of the fifth slider in a direction from the second upper section of the second segment of the blanket toward the second lower section of the second segment of the blanket extending along the second upper section of the second segment of the blanket to allow the third coverlet to be moved away from the second upper section of the second segment of the blanket and the central section of the blanket extending along the second upper section of the second segment of the blanket while leaving the third marginal edge of the third coverlet secured to the central section of the blanket extending along the second lower section of the second segment of the blanket, and to release the third marginal edge of the third coverlet from the central section of the blanket in response to movement of the sixth slider in a direction from the second lower section of the second segment of the blanket toward the second upper section of the second segment of the blanket extending along the second lower section of the second segment of the blanket to allow the third coverlet to be moved away from the second lower section of the second segment of the blanket and the central section of the blanket extending along the second lower section of the second segment of the blanket while leaving the third marginal edge of the third coverlet secured to the central section of the blanket extending along the second upper section of the second segment of the blanket. There is still further a fourth coverlet having a fourth marginal edge. A fourth slide fastener assembly, incorporating opposed seventh and eighth sliders, is formed between the central section of the blanket and the fourth marginal edge of the fourth coverlet to releasably connect the fourth marginal edge of the fourth coverlet to the central section of the blanket. The fourth slide fastener assembly is operable to secure the fourth marginal edge of the fourth coverlet to and along the central section of the blanket in a fourth secured condition of the fourth coverlet to allow the fourth coverlet to be laid across the second segment of the blanket and the third coverlet in the third secured condition of the third coverlet laid across the second segment of the blanket, to release the fourth marginal edge of the fourth coverlet from the central section of the blanket in response to movement of the seventh slider in a direction from the second upper section of the second segment of the blanket toward the second lower section of the second segment of the blanket extending along the second upper section of the second segment of the blanket to allow the fourth coverlet to be moved away from the second upper section of the second segment of the blanket and the central section of the blanket extending along the second upper section of the second segment of the blanket while leaving the fourth marginal edge of the fourth coverlet secured to the central section of the blanket extending along the second lower section of the second segment of the blanket, and to release the fourth marginal edge of the fourth coverlet from the central section of the blanket in response to movement of the eighth slider in a direction from the second lower section of the second segment of the blanket toward the second upper section of the second segment of the blanket extending along the second lower section of the second segment of the blanket to allow the fourth coverlet to be moved away from the second lower section of the second segment of the blanket and the central section of the blanket extending along the second lower section of the second segment of the blanket while leaving the fourth marginal edge of the fourth coverlet secured to the central section of the blanket extending along the second upper section of the second segment of the blanket. The third coverlet has a third warmth characteristic, and the fourth coverlet has a fourth warmth characteristic different from the third warmth characteristic of the third coverlet. The first slide fastener assembly is further operable to release the first marginal edge of the first coverlet from the central section of the blanket to detach the first coverlet from the blanket. The second slide fastener assembly is further operable to release the second marginal edge of the second coverlet from the central section of the blanket to detach the second coverlet from the blanket. The third slide fastener assembly is further operable to release the third marginal edge of the third coverlet from the central section of the blanket to detach the third coverlet from the blanket. The fourth slide fastener assembly is further operable to release the fourth marginal edge of the fourth coverlet from the central section of the blanket to detach the fourth coverlet from the blanket.

According to the principle of the invention, a bedclothes apparatus includes a blanket having opposed first and second sides, a first coverlet having opposed first and second ends, and a second coverlet having opposed third and fourth ends. A first slide fastener assembly, incorporating opposed first and second sliders, is formed between the blanket and the first coverlet. A second slide fastener assembly, incorporating opposed third and fourth sliders, is formed between the blanket and the second coverlet. The first slide fastener assembly is operable to secure the first coverlet to the blanket in a first secured condition of the first coverlet to allow the first coverlet to be laid across the first side of the blanket, to release the first coverlet from the blanket in response to movement of the first slider in a direction from the first end of the first coverlet to the second end of the first coverlet to allow the first end of the first coverlet to be moved away from the blanket while leaving the second end of the first coverlet secured to the blanket, and to release the first coverlet from the blanket in response to movement of the second slider in a direction from the second end of the first coverlet to the first end of the first coverlet to allow the second end of the first coverlet to be moved away from the blanket while leaving the first end of the first coverlet secured to the blanket. The second slide fastener assembly is operable to secure the second coverlet to the blanket in a second secured condition of the second coverlet to allow the second coverlet to be laid across the first side of the blanket and the first coverlet in the first secured condition of the first coverlet laid across the first side of the blanket, to release the second coverlet from the blanket in response to movement of the third slider in a direction from the third end of the second coverlet to the fourth end of the second coverlet to allow the third end of the second coverlet to be moved away from the blanket while leaving the fourth end of the second coverlet secured to the blanket, and to release the second coverlet from the blanket in response to movement of the fourth slider in a direction from the fourth end of the second coverlet to the third end of the second coverlet to allow the fourth end of the second coverlet to be moved away from the blanket while leaving the third end of the second coverlet secured to the blanket. The first coverlet has a first warmth characteristic, and the second coverlet has a second warmth characteristic different from the first warmth characteristic of the first coverlet. There is also a third coverlet having opposed fifth and sixth ends, and a fourth coverlet having opposed seventh and eighth ends. A third slide fastener assembly, incorporating opposed fifth and sixth sliders, is formed between the blanket and the third coverlet. A fourth slide fastener assembly, incorporating opposed seventh and eighth sliders, is formed between the blanket and the fourth coverlet. The third slide fastener assembly is operable to secure the third coverlet to the blanket in a third secured condition of the third coverlet to allow the third coverlet to be laid across the second side of the blanket, to release the third coverlet from the blanket in response to movement of the fifth slider in a direction from the fifth end of the third coverlet to the sixth end of the third coverlet to allow the fifth end of the third coverlet to be moved away from the blanket while leaving the sixth end of the third coverlet secured to the blanket, and to release the third coverlet from the blanket in response to movement of the sixth slider in a direction from the sixth end of the third coverlet to the fifth end of the third coverlet to allow the sixth end of the third coverlet to be moved away from the blanket while leaving the fifth end of the third coverlet secured to the blanket. The fourth slide fastener assembly is operable to secure the fourth coverlet to the blanket in a fourth secured condition of the fourth coverlet to allow the fourth coverlet to be laid across the second side of the blanket and the third coverlet in the third secured condition of the third coverlet laid across the second side of the blanket, to release the fourth coverlet from the blanket in response to movement of the seventh slider in a direction from the seventh end of the fourth coverlet to the eighth end of the fourth coverlet to allow the seventh end of the fourth coverlet to be moved away from the blanket while leaving the eighth end of the fourth coverlet secured to the blanket, and to release the fourth coverlet from the blanket in response to movement of the eighth slider in a direction from the eighth end of the fourth coverlet to the seventh end of the fourth coverlet to allow the eighth end of the fourth coverlet to be moved away from the blanket while leaving the seventh end of the fourth coverlet secured to the blanket. The third coverlet has a third warmth characteristic, and the fourth coverlet has a fourth warmth characteristic different from the third warmth characteristic of the third coverlet. The first slide fastener assembly is further operable to release the first coverlet from the blanket to detach the first coverlet from the blanket. The second slide fastener assembly is further operable to release the second coverlet from the blanket to detach the second coverlet from the blanket. The third slide fastener assembly is further operable to release the third coverlet from the blanket to detach the third coverlet from the blanket. The fourth slide fastener assembly is further operable to release the fourth coverlet from the blanket to detach the fourth coverlet from the blanket.

BRIEF DESCRIPTION OF THE DRAWINGS

Referring to the drawings.

DETAILED DESCRIPTION

Figure 1:
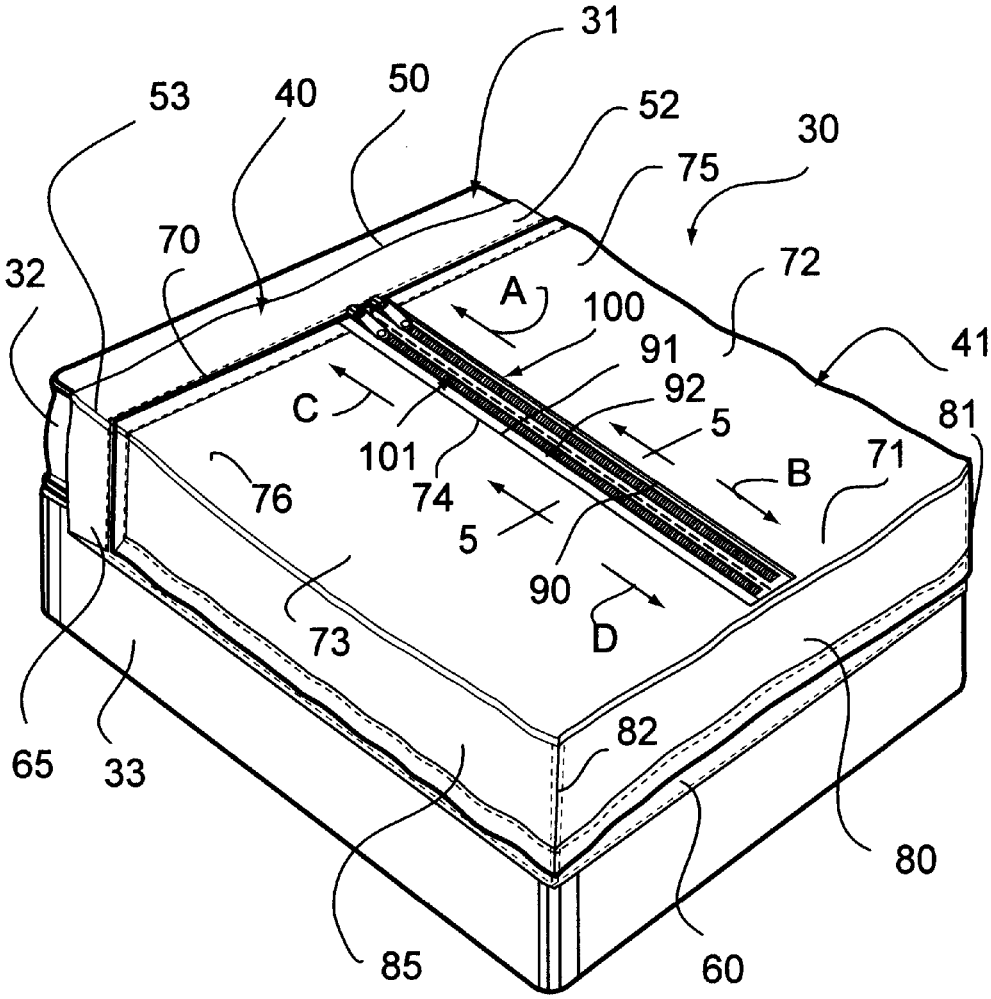
FIG. 1 is a perspective view of a bedclothes apparatus shown as it would appear assembled and installed on a bed, the bedclothes apparatus constructed and arranged in accordance with the principle of the invention.
Figure 2:
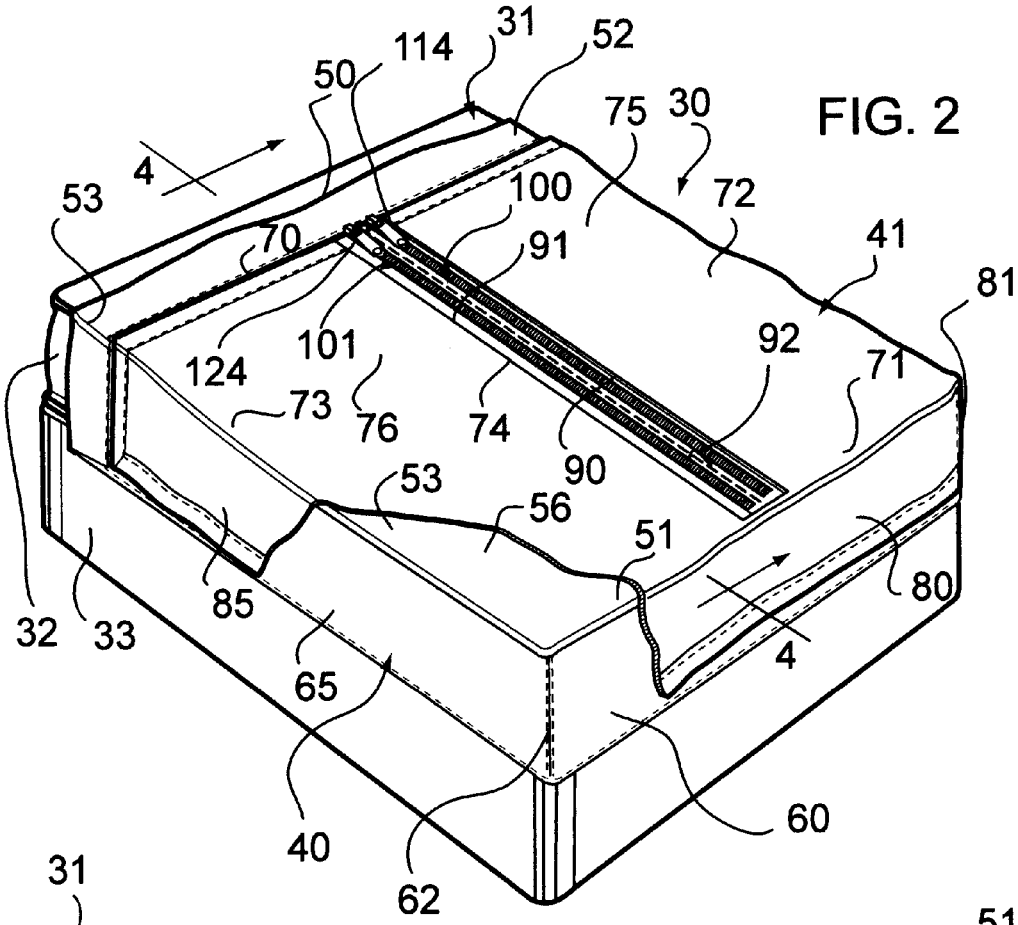
FIG. 2 is a view similar to that of FIG. 1 illustrating portions of the bedclothes apparatus broken away for illustrative purposes.

Turning now to the drawings, in which like reference characters indicate corresponding elements throughout the several views, attention is first directed to FIGS. 1 and 2 in which there is seen a perspective view of a bedclothes apparatus 30 shown as it would appear assembled and installed on a bed of conventional construction as designated by the reference character 31, which includes the usual mattress 32 positioned atop the usual box spring base 33. Bed 31 may be configured with other conventional structural features such as a bed frame onto which box spring base 33 will typically lie on, a head board, a foot board, and the like. Bed 31 is exemplary of a conventional double bed, queen bed, or king bed being exemplary of the type of bed suitable to comfortably sleep two people. Bedclothes apparatus 30 is an assembly and, according to the principle of the invention, includes opposed, substantially coextensive blankets 40 and 41 each sized to cover two occupants of bed 31. Blanket 40 is a lower or inner blanket of bedclothes apparatus 30, and blanket 41 is an upper or outer blanket of bedclothes apparatus 30. Blanket 41 rests atop blanket 40, which is positioned upon mattress 32 as illustrated in FIGS. 1 and 2 and also FIG. 4, which is a sectional view taken along line 4-4 of FIG. 2.

Figure 3:
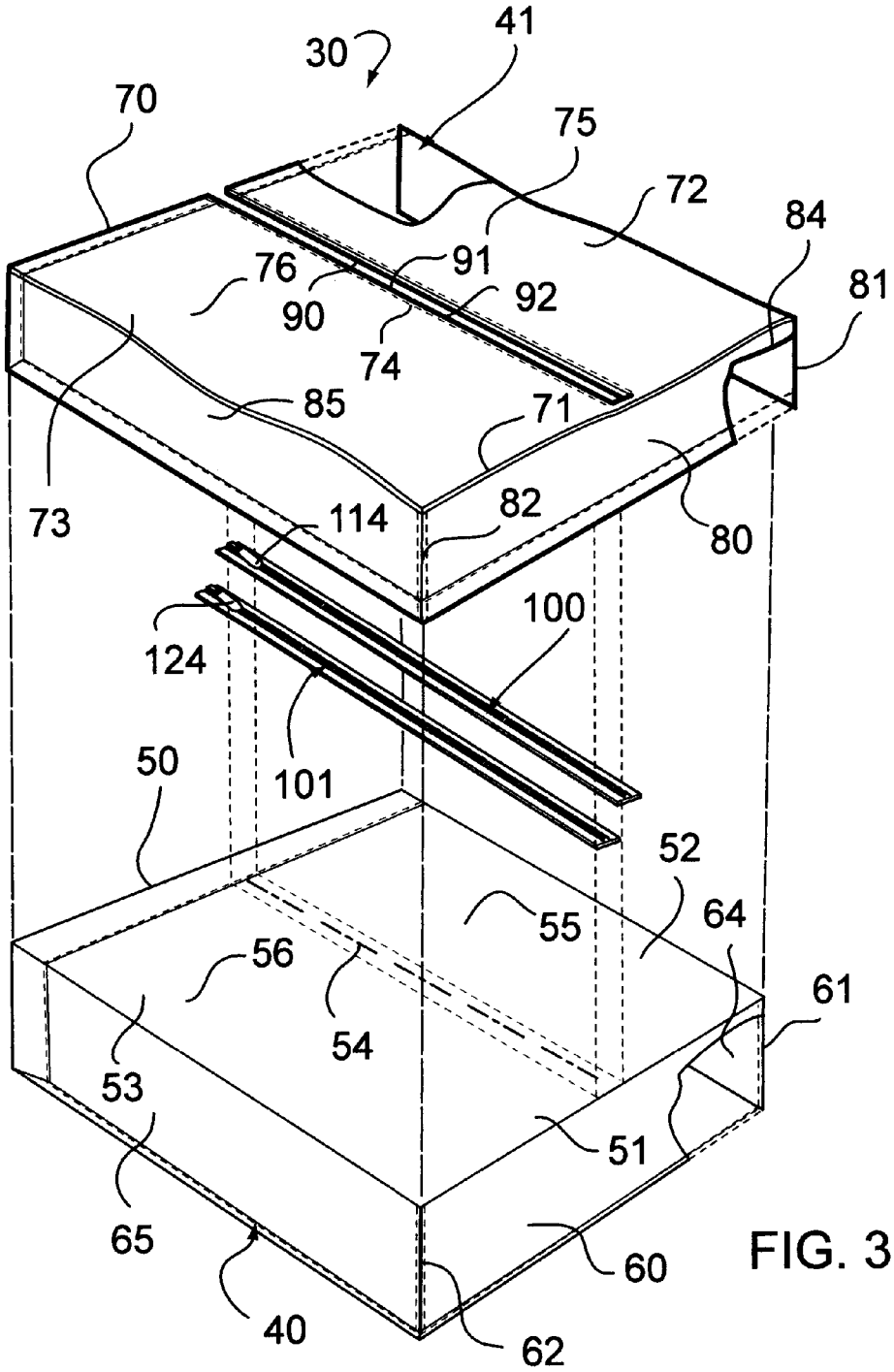
FIG. 3 is an exploded perspective view of the bedclothes apparatus of FIG. 1.

Referencing FIG. 3, which is an exploded perspective view of bedclothes apparatus 30, blanket 40 is a large, broad piece of cloth, and includes opposed ends 50 and 51, and opposed sides 52 and 53, and a central section 54 between opposed sides 52 and 53 extending from end 50 of blanket 40 to end 51 of blanket 40 and which is parallel with respect to sides 52 and 53 and perpendicular with respect to ends 50 and 51. Central section 54 divides blanket 40 in two opposed halves or segments 55 and 56, which, in the present embodiment, are substantially equal in size and shape. The first half or segment 55 of blanket 40 extends from central section 54 to side 52 of blanket 40 and from and between end 50 of blanket 40 to end 51 of blanket 40 to cover an occupant lying on one side of mattress 32. The second half or segment 56 of blanket 40 extends from central section 54 to side 53 of blanket 40 and from and between end 50 of blanket 40 to end 51 of blanket 40 to cover another occupant lying on the other side of mattress 32.

In this embodiment, blanket 40 is a "fitted" blanket in that its end 51 and sides 52 and 53 are structured to fit about mattress 32 denoted in FIGS. 1-3. In characterizing the fitted construction of blanket 40, end 51 of blanket is constructed with an end panel 60 extending between opposed corners 61 and 62 formed in end 51 of blanket 40 at sides 52 and 53, respectively, side 52 of blanket 40 is formed with a side panel 64 extending from corner 61 to end 50 of blanket 40, and side 53 of blanket 40 is formed with a side panel 65 extending from corner 62 to end 50 of blanket 40. Side panel 64 and the portion of end panel 60 extending generally from central section 54 of blanket 40 to corner 61 can be considered part of or otherwise an extension of half or segment 55 of blanket 40, and side panel 65 and the portion of end panel 60 extending generally from central section 54 of blanket 40 to corner 62 can be considered part of or otherwise an extension of half or segment 56 of blanket 40. End 50 of blanket 40 is the upper end of blanket 40 designed to be positioned at head 32A of mattress 32 denoted in FIG. 4, and end 51 is designed to be positioned at foot 32B of mattress 32 denoted in FIG. 4, in which the fitted construction of blanket 40 is provided such that corners 61 and 62 fit downwardly about the opposed corners on either side of foot 32B of mattress 32 and end panel 60 extends downwardly and across foot 32B of mattress 32 between corners 61 and 62, side panel 64 extends downwardly and across one side of mattress 32 from corner 61 to end 50 of blanket 40, and side panel 65 extends downwardly and across the opposed side of mattress 32 from corner 62 to end 50 of blanket 40. The fitted construction of blanket 40 prevents blanket 40 from shifting during use of bedclothes apparatus 30 as disclosed herein.

Referencing FIG. 3, blanket 41 is a large, broad piece of cloth, and includes opposed ends 70 and 71, and opposed sides 72 and 73, and a central section 74 between opposed sides 72 and 73 extending from end 70 of blanket 41 to end 71 of blanket 41 and which is parallel with respect to sides 72 and 73 and perpendicular with respect to ends 70 and 71. Central section 74 divides blanket 71 in two opposed coverlets 75 and 76, which are substantially equal in size and shape. The first coverlet 75 of blanket 41 extends from central section 74 to side 72 of blanket 41 and from and between end 70 of blanket 41 to end 71 of blanket 41. The second coverlet 76 of blanket 41 extends from central section 74 to side 73 of blanket 41 and from and between end 70 of blanket 41 to end 71 of blanket 41. Blanket 41 is positioned atop blanket 40 installed on mattress 32 as discussed above, in which coverlet 75 extends over and across segment 55 of blanket 40, coverlet 76 extends over and across segment 56 of blanket 40, end 70 of blanket 41 extends over across blanket 40 adjacent to end 50 of blanket 40, end 71 of blanket 41 extends over and across blanket adjacent to end 51 of blanket 40 and end panel 80 extends over and across end panel 60, side 72 of blanket 41 extends over and across side 52 of blanket 40 and side panel 84 extends over and across side panel 64 of blanket 40, and side 73 of blanket 41 extends over and across side 53 of blanket 40 and side panel 85 extends over and across side panel 65 of blanket 40.

In this embodiment, like blanket 40, blanket 41 is a fitted blanket in that it is structured to fit about blanket 40 fitted about mattress 32 as discussed above. In characterizing the fitted construction of blanket 41, end 71 of blanket is constructed with an end panel 80 extending between opposed corners 81 and 82 formed in end 71 of blanket 41 at sides 72 and 73, respectively, side 72 of blanket 41 is formed with a side panel 84 extending from corner 81 to end 70 of blanket 41, and side 73 of blanket 41 is formed with a side panel 85 extending from corner 82 to end 70 of blanket 41. Side panel 84 and the portion of end panel 80 extending generally from central section 74 to corner 81 can be considered part of or otherwise an extension of coverlet 75 of blanket 41, and side panel 85 and the portion of end panel 80 extending generally from central section 74 to corner 82 can be considered part of or otherwise an extension of coverlet 76 of blanket 41. End 70 of blanket 41 is the upper end of blanket 41 designed to be positioned at head 32A of mattress 32 denoted in FIG. 4, and end 71 of blanket 41 is designed to be positioned at foot 32B of mattress 32 denoted in FIG. 4, in which the fitted construction of blanket 41 is provided such that corners 81 and 82 fit downwardly about the opposed corners of mattress 32 on either side of foot 32B of mattress 32 and end panel 80 extends downwardly and across foot 32B of mattress 32 between corners 81 and 82, side panel 84 extends downwardly and across one side of mattress 32 from corner 81 to end 50 of blanket 40, and side panel 85 extends across the opposed side of mattress 32 from corner 82 to end 50 of blanket 40.

Referencing FIG. 3, blanket 41 is partially severed along central section 74 from end 70 of blanket to a point proximate to and just inboard of end 71 of blanket 41 leaving blanket connected along end panel 80 end 71 of blanket 41 while forming opposed, parallel marginal edges 90 and 91 in blanket 41 and a gap 92 therebetween, and further forming coverlet 75 of blanket 41 extending from marginal edge 90 on one side of gap 92 to side 72 of blanket 41 and between ends 70 and 71 blanket 41, and coverlet 76 of blanket 41 extending from marginal edge 91 on the opposed side of gap 92 to side 73 of blanket 41 and between ends 70 and 71 blanket 41. Segment 55 of blanket 40 is substantially coextensive with respect to segment 56 of blanket 40, coverlet 75 of blanket 41 is substantially coextensive with respect to coverlet 76 of blanket 41, coverlet 75 of blanket 41 is substantially coextensive with respect to segment 55 of blanket 40, and coverlet 76 of blanket 41 is substantially coextensive with respect to segment 56 of blanket 40.

Referencing FIGS. 1-3 and 5, bedclothes apparatus 30 is formed with fastener assemblies 100 and 101. Fastener assembly 100 is formed and coupled between marginal edge 90 of coverlet 75 of blanket 41 and central section 54 (referenced in FIGS. 3 and 5) of blanket 40 to releasably connect marginal edge 90 of coverlet 75 of blanket 41 to central section 54 of blanket 40, and fastener assembly 101 is formed and coupled between marginal edge 91 of coverlet 76 of blanket 41 and central section 54 (referenced in FIGS. 3 and 5) of blanket 40 to releasably connect marginal edge 91 of coverlet 76 of blanket 41 to central section 54 of blanket 40. Fastener assembly 100 runs along entire length of marginal edge 90 and gap 92 and is operable for securing and releasing coverlet 75 with respect to blanket 40, and fastener assembly 101 likewise runs along the entire length of marginal edge 91 and gap 92 and is operable for securing and releasing coverlet 76 with respect to blanket 40.

Figure 5:
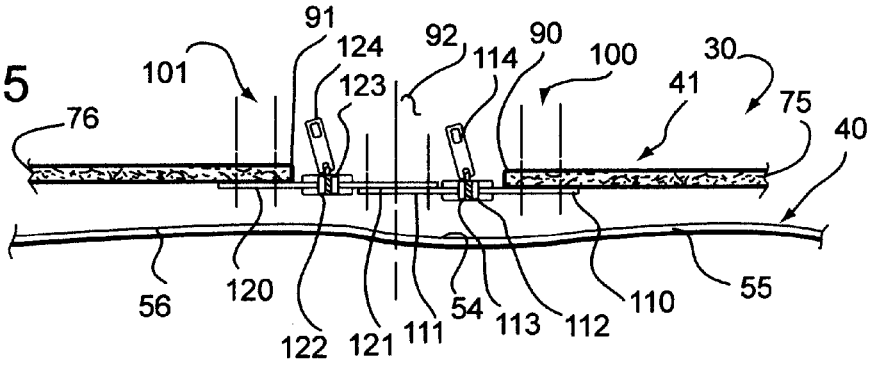
FIG. 5 is a sectional view taken along line 5-5 of FIG. 1.

Looking to FIG. 5, which is a sectional view taken along line 5-5 of FIG. 1, fastener assemblies 100 and 101 are fitted at gap 92. Fastener assembly 100 is a slide fastener assembly consisting of two strips 110 and 111 of fabric tape that carry complementing rows 112 and 113 of metal or plastic teeth, and a slider 114. Row 112 of teeth may be referred to as an element or engagement element of fastener assembly 100, and row 113 of teeth may be referred to as a complementing element or complementing engagement element of fastener assembly 100. The slider 114, operated by hand, moves along rows 112 and 113 of teeth and meshes together or separates rows 112 and 113 of teeth depending on the direction of movement. According to the invention, slider 114 meshes rows 112 and 113 of teeth together when moved in the direction indicated by the arrowed line A in FIG. 1 toward end 70 of blanket 40, and separates rows 112 and 113 of teeth when moved in the direction indicated by the arrowed line B in FIG. 1 toward end 71 of blanket 41. Fastener assembly 101 is, like fastener assembly 100, a slide fastener assembly consisting of two strips 120 and 121 of fabric tape that carry complementing rows 122 and 123 of metal or plastic teeth, and a slider 124. Row 122 of teeth may be referred to as an element or engagement element of fastener assembly 101, and row 123 of teeth may be referred to as a complementing element or complementing engagement element of fastener assembly 101. The slider 124, operated by hand, moves along rows 122 and 123 of teeth and meshes together or separates rows 122 and 123 of teeth depending on the direction of movement. According to the invention, slider 124 meshes rows 122 and 123 of teeth together when moved in the direction indicated by the arrowed line C in FIG. 1 toward end 70 of blanket 40, and separates rows 122 and 123 of teeth when moved in the direction indicated by the arrowed line D in FIG. 1 toward end 71 of blanket 41.

Figure 4:
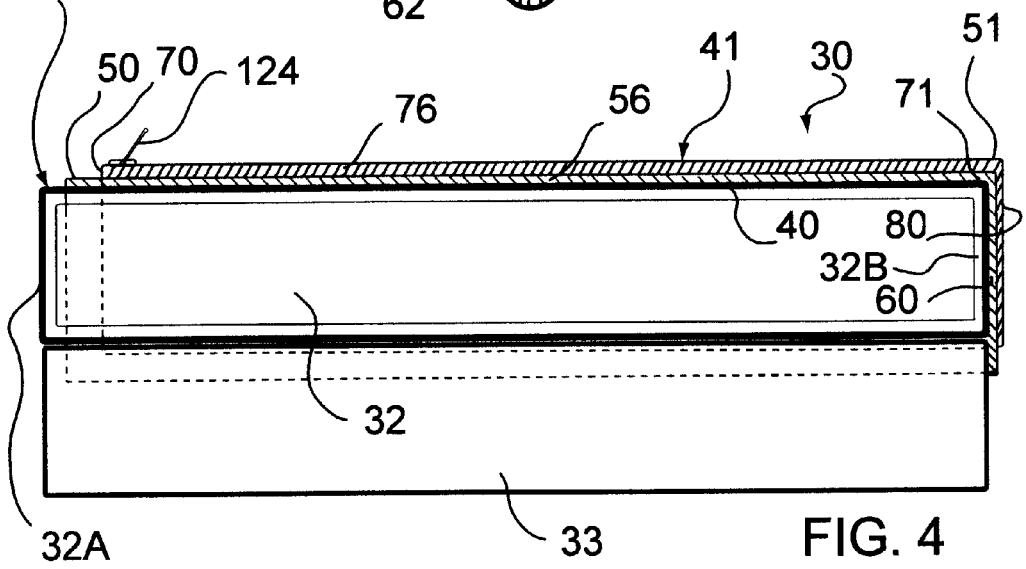
FIG. 4 is a sectional view taken along line 4-4 of FIG. 2.
Figure 6:
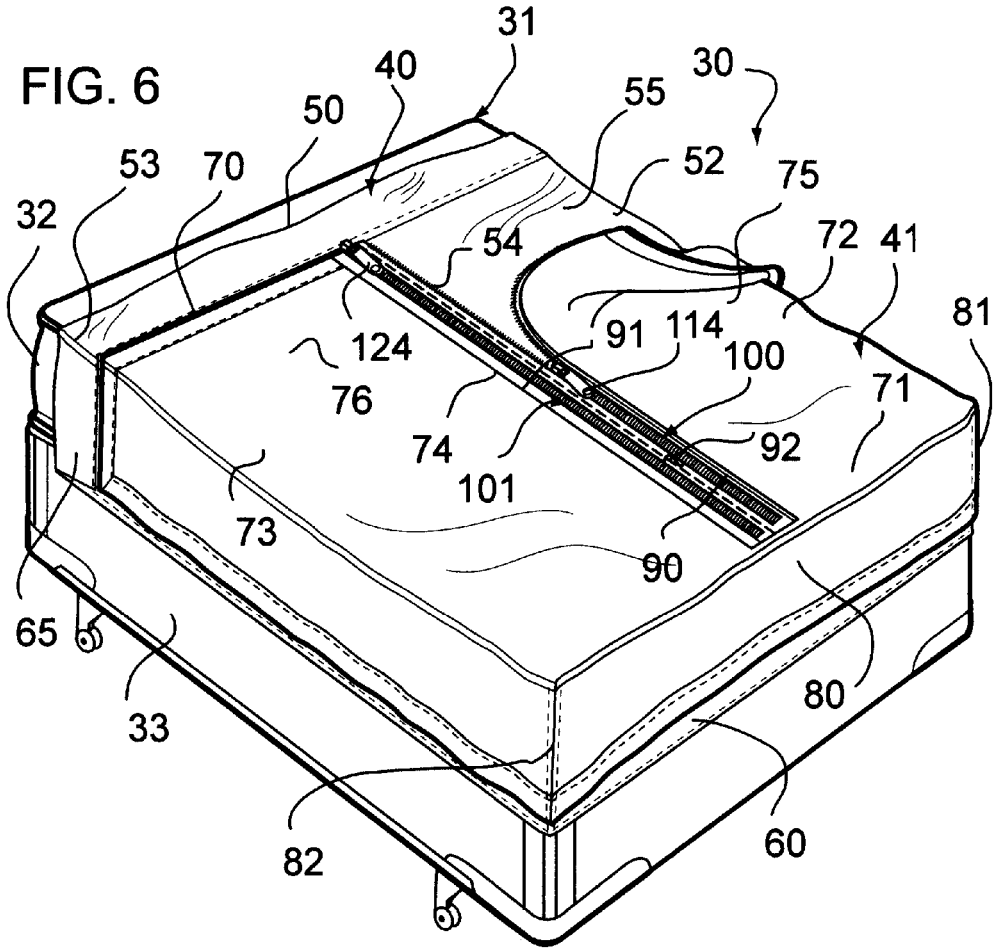
FIG. 6 is a perspective view similar to that of FIG. 1 illustrating a coverlet partially detached from a blanket of the bedclothes apparatus.

Strips 111 and 121 are affixed to each other and also to central section 54 of blanket 40, such as with stitching or heat bonding or adhesive or the like. Fastener assembly 100 is operable independently of fastener assembly 101 to secure marginal edge 90 of coverlet 75 with respect to or otherwise to and along central section 54 of blanket 40 to allow coverlet 75 to be laid across segment 55 of blanket 40 as shown in FIGS. 1 and 2, and to release marginal edge 90 of coverlet 75 from central section 54 as shown in FIG. 6 by sliding slider 114 toward end 71 of blanket 41 away from end 70 of blanket 41 to allow coverlet 75 at end 70 to be peeled, folded, or otherwise moved away from segment 55 of blanket 40 and central section 54 of blanket 40 from end 50 of blanket 40, such as when an occupant lying on mattress 32 under segment 55 is too hot and wishes to uncover himself from coverlet 75 from end 50 of blanket 40. Because strips 111 and 121 are affixed to each other and also to central section 54 of blanket 40, fastener assembly 101 is, likewise, operable independently of fastener assembly 100 to secure marginal edge 91 of coverlet 76 with respect to or otherwise to and along central section 54 of blanket 40 to allow coverlet 76 to be laid across segment 56 of blanket 40 as shown in FIGS. 1, 2, and 4, and to release marginal edge 91 of coverlet 76 from central section 54 by sliding slider 124 toward end 71 of blanket 41 away from end 70 of blanket 41 to allow coverlet 76 from end 70 thereof to be peeled, folded, or otherwise moved away from segment 56 of blanket 40 and central section 54 of blanket 40 from end 50 of blanket 40 in exactly the same manner as described and shown in connection with coverlet 76, such as when an occupant lying on mattress 32 under segment 56 is too hot and wishes to uncover himself from coverlet 76. Because strips 111 and 121 are affixed to each other and also to central section 54 of blanket 40, coverlet 75 can be secured and released with respect to central section 54 of blanket independent of and without disturbing coverlet 76, and coverlet 76 can be secured and released with respect to central section of blanket 40 as may be desired with respect to and without disturbing coverlet 75. It is to be understood that with both coverlets 75 and 76 in their secured positions, movement of either coverlet 75 or 76 from its secured position to its released position through the operation of its respective fastener assembly will not disturb the other one of coverlets 75 and 76 from its secured position, in accordance with the principle of the invention, and this is dictated by the structure of the respective fastener assemblies 100 and 101 and their attachment to, and structural association with, blankets 40 and 41.

The fitted configuration of end 71 of blanket 41 helps in the operation of fastener assemblies 100 and 101 by effectively securing blanket 41 in place with respect to mattress 32 and thus stabilizing blanket 41 as sliders 114 and 124 are moved back and forth to secure and release coverlets 75 and 76 during use of bedclothes apparatus 30. Moreover, because blanket 41 is only partially severed as described and is left connected along end panel 80 end 71 of blanket 41, blanket 41 is integrated and bedclothes apparatus 30 is also, therefore, integrated and will not fall apart.

Figure 7:
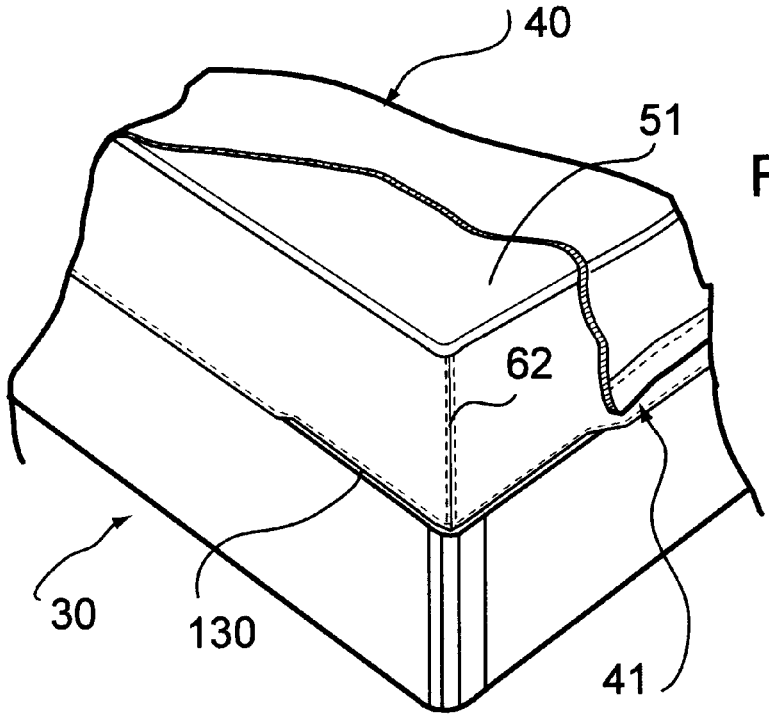
FIG. 7 is a fragmented perspective view of the bedclothes apparatus of FIG. 1 shown with a blanket of the bedclothes apparatus formed with a fitted, elastic end.

If desired, corners 61 and 62 and end 51 of blanket 40 can be formed with elastic as with well-known elastic fitted sheets to elastically fit end 51 of blanket 40 to mattress 32 to further secure end 51 of cover 40 to mattress 32 to prevent cover 40 from shifting during use of bedclothes apparatus 30. To illustrate this, FIG. 7 is a fragmented perspective view of bedclothes apparatus 30 illustrating end 51 of cover 40 at corner 62 formed with an elastic section 130 as is commonly found among conventional elastic fitted sheets. Although not shown, end 51 of cover 40 at corner 61 can be similarly constructed if so desired, in which case such disclosed details of end 51 of cover 40 at corner 62 apply equally to end 51 of cover 40 at corner 61.

Blanket 40 and blanket 41 are each fitted blankets in the preferred embodiment. In alternate embodiments, blanket 40 can be unfitted and simply constructed as a broad flat blanket, and blanket 41 can be unfitted and simply constructed as a broad, flat blanket. Blanket 40 is used underneath blanket 41.

As such, blanket is preferably constructed to be thicker and/or warmer with respect to blanket 40. As such, blanket 40 is preferably a sheet, namely, a top sheet under which a user sleeps, and blanket is preferably 40 formed as a thicker and/or warmer blanket, such as a quilt, duvet, comforter, or the like, that is laid atop blanket 40 for warmth.

Figure 8:
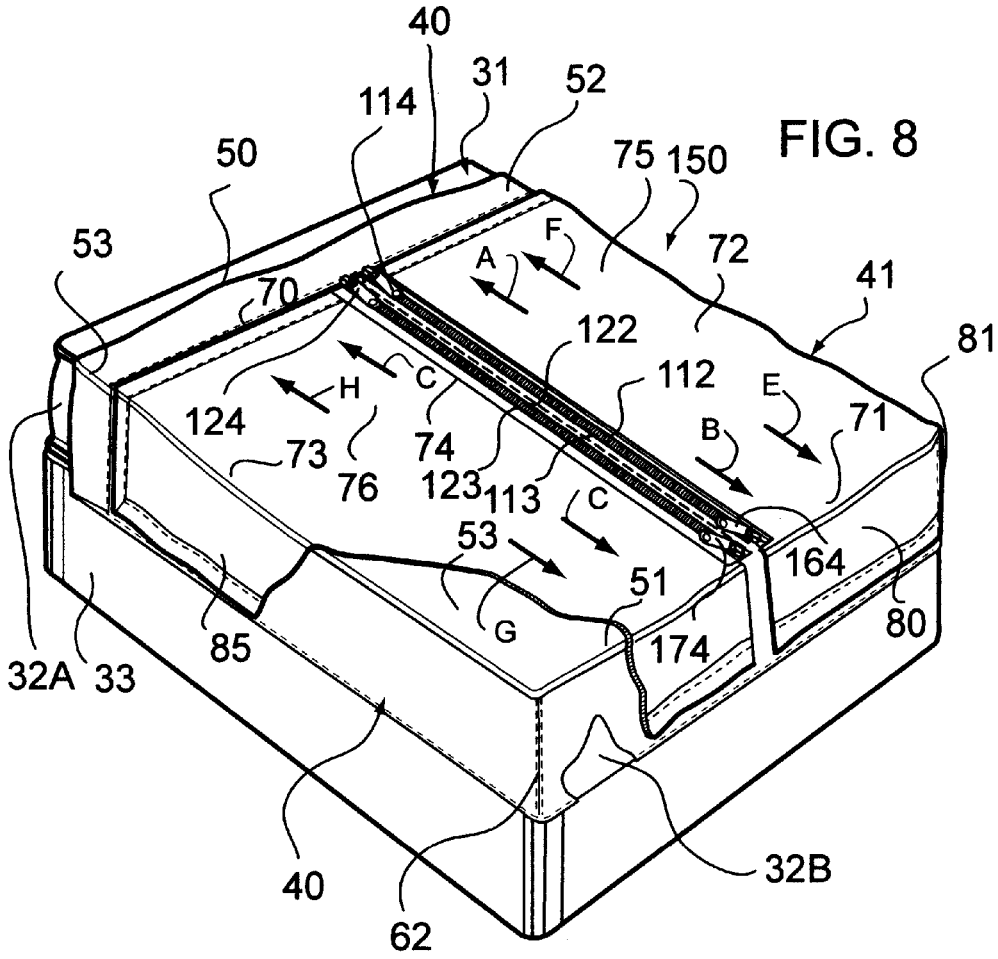
FIG. 8 is a perspective view of an alternate embodiment of a bedclothes apparatus shown as it would appear assembled and installed on a bed with portions of the bedclothes apparatus broken away for illustrative purposes, the bedclothes apparatus constructed and arranged in accordance with the principle of the invention.
Figure 9:
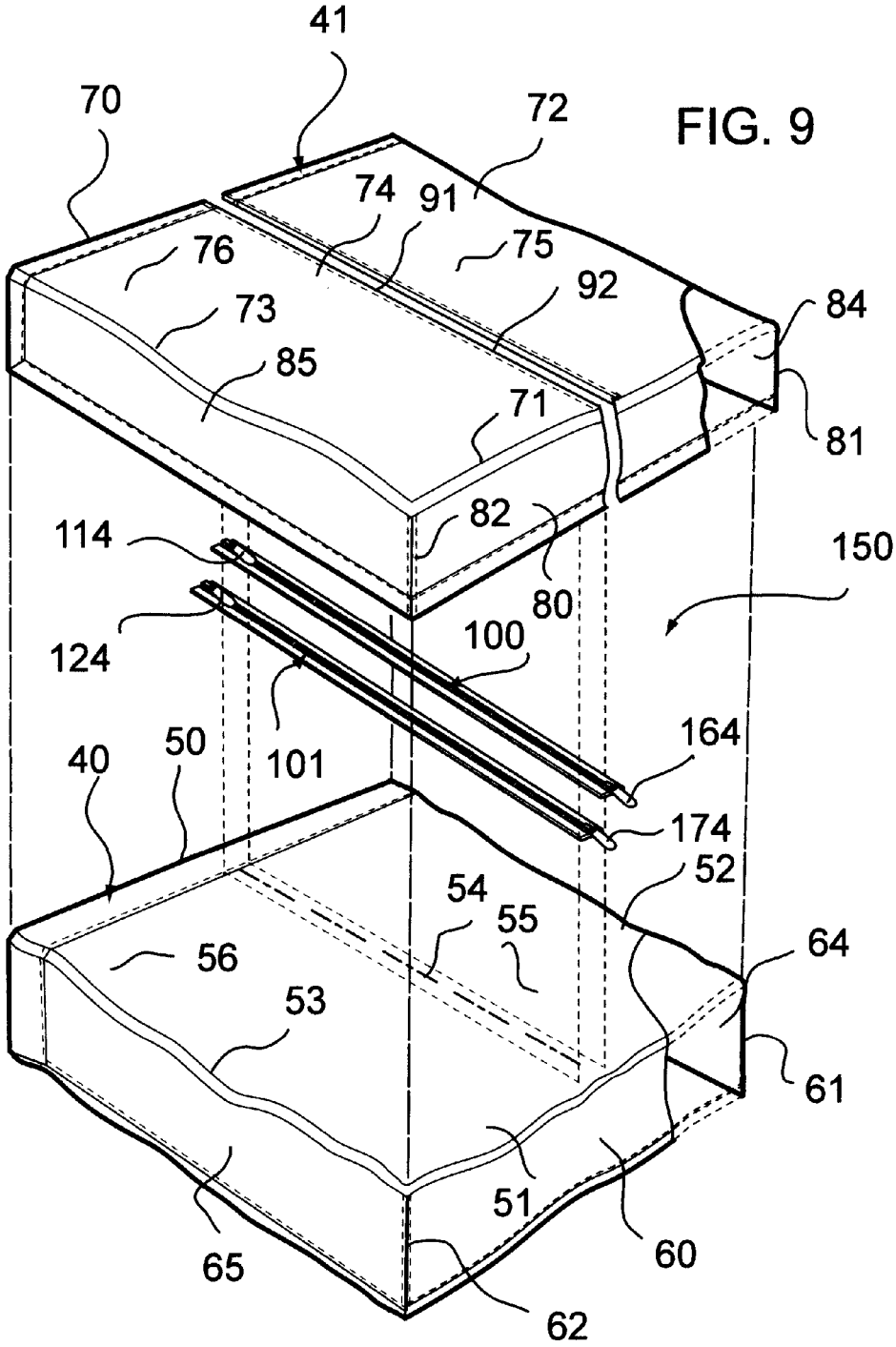
FIG. 9 is an exploded perspective view of the bedclothes apparatus of FIG. 8.

Reference is now made to FIG. 8 in which there is seen a perspective view of an alternate embodiment of a bedclothes apparatus 150 constructed and arranged in accordance with the principle of the invention and shown as it would appear assembled and installed on 31 including mattress 32 and box springs 33. In common with bedclothes apparatus 30 bedclothes apparatus 150, as illustrated in FIG. 9, shares blanket 40 having opposed ends 50 and 51, opposed sides 52 and 53, and central section 54 between opposed sides 52 and 53 extending from end 50 of blanket 40 to end 51 of blanket 40, which divides blanket 40 in two opposed substantially equal halves or segments 55 and 56. First half or segment 55 of blanket 40 extends from central section 54 to side 52 of blanket 40 and from and between end 50 of blanket 40 to end 51 of blanket 40 to cover an occupant lying on one side of mattress 32, and second half or segment 56 of blanket 40 extends from central section 54 to side 53 of blanket 40 and from and between end 50 of blanket 40 to end 51 of blanket 40 to cover another occupant lying on the other side of mattress 32. Blanket 40 in bedclothes apparatus 150 is a fitted blanket in that it is structured to fit about mattress 32. In common with blanket 40 in bedclothes apparatus 30, blanket 40 in bedclothes apparatus 150 further shares end panel 60 extending between opposed corners 61 and 62 formed in end 51 of blanket 40 at sides 52 and 53, respectively, side 52 of blanket 40 formed with side panel 64 extending from corner 61 to end 50 of blanket 40, and side 53 of blanket 40 formed with side panel 65 extending from corner 62 to end 50 of blanket 40. Side panel 64 and the portion of end panel 60 extending generally from central section 54 to corner 61 can be considered part of or otherwise an extension of half or segment 55 of blanket 40, and side panel 65 and the portion of end panel 60 extending generally from central section 54 to corner 62 can be considered part of or otherwise an extension of half or segment 56 of blanket 40. End 50 of blanket 40 is the upper end of blanket 40 designed to be positioned at head 32A of mattress 32 denoted in FIG. 8, and end 51 is designed to be positioned at foot 32B of mattress 32, in which the fitted construction of blanket 40 is provided such that corners 61 and 62 fit downwardly about the opposed corners on either side of foot 32B of mattress 32 and end panel 60 extends downwardly and across foot 32B of mattress 32 between corners 61 and 62, side panel 64 extends downwardly and across one side of mattress 32 from corner 61 to end 50 of blanket 40, and side panel 65 extends downwardly and across the opposed side of mattress 32 from corner 62 to end 50 of blanket 40.

Further in common with bedclothes apparatus 30, bedclothes apparatus 150 shares blanket 41 including opposed ends 70 and 71, opposed sides 72 and 73, and central section 74 between opposed sides 72 and 73 extending from end 70 of blanket 41 to end 71 of blanket 41 dividing blanket 71 in two opposed substantially equal coverlets 75 and 76. The first coverlet 75 of blanket 41 extends from central section 74 to side 72 of blanket 41 and from and between end 70 of blanket 41 to end 71 of blanket 41. The second coverlet 76 of blanket 41 extends from central section 74 to side 73 of blanket 41 and from and between end 70 of blanket 41 to end 71 of blanket 41. Blanket 41 is positioned atop blanket 40, in which coverlet 75 extends over and across segment 55 of blanket 40, coverlet 76 extends over and across segment 56 of blanket 40, end 70 of blanket 41 extends over across blanket 40 adjacent to end 50 of blanket 40, end 71 of blanket 41 extends over and across blanket adjacent to end 51 of blanket 40 and end panel 80 extends over and across end panel 60, side 72 of blanket 41 extends over and across side 52 of blanket 40 and side panel 84 extends over and across side panel 64 of blanket 40, and side 73 of blanket 41 extends over and across side 53 of blanket 40 and side panel 85 extends over and across side panel 65 of blanket 40.

Like blanket 40, blanket 41 in bedclothes apparatus 140 is, as in bedclothes apparatus 30, a fitted blanket in that it is structured to fit about blanket 40 fitted about mattress 32. In characterizing the fitted construction of blanket 41, end 71 of blanket is constructed with end panel 80 extending between opposed corners 81 and 82 formed in end 71 of blanket 41 at sides 72 and 73, respectively, side 72 of blanket 41 is formed with side panel 84 extending from corner 81 to end 70 of blanket 41, and side 73 of blanket 41 is formed with side panel 85 extending from corner 82 to end 70 of blanket 41. Side panel 84 and the portion of end panel 80 extending generally from central section 74 to corner 81 can be considered part of or otherwise an extension of coverlet 75 of blanket 41, and side panel 85 and the portion of end panel 80 extending generally from central section 74 to corner 82 can be considered part of or otherwise an extension of coverlet 76 of blanket 41. End 70 of blanket 41 is the upper end of blanket 41 designed to be positioned at head 32A of mattress 32 denoted in FIG. 8, and end 71 is designed to be positioned at foot 32B of mattress 32, in which the fitted construction of blanket 41 is provided such that corners 81 and 82 fit downwardly about the opposed corners of mattress 32 on either side of foot 32B of mattress 32 and end panel 80 extends downwardly and across foot 32B of mattress 32 between corners 81 and 82, side panel 84 extends downwardly and across one side of mattress 32 from corner 81 to end 50 of blanket 40, and side panel 85 extends downwardly and across the opposed side of mattress 32 from corner 82 to end 50 of blanket 40.

Blanket 41 of bedclothes apparatus 150 is, as with blanket 41 in bedclothes apparatus 30, severed along central section 74 from end 70 of blanket to a point proximate to and just inboard of end 71 of blanket 41 forming opposed, parallel marginal edges 90 and 91 in blanket 41 and gap 92 therebetween, and further forming coverlet 75 of blanket 41 extending from marginal edge 90 on one side of gap 92 to side 72 of blanket 41 and between ends 70 and 71 blanket 41, and coverlet 76 of blanket 41 extending from marginal edge 91 on the opposed side of gap 92 to side 73 of blanket 41 and between ends 70 and 71 blanket 41. Segment 55 of blanket 40 is substantially coextensive with respect to segment 56 of blanket 40, coverlet 75 of blanket 41 is substantially coextensive with respect to coverlet 76 of blanket 41, coverlet 75 of blanket 41 is substantially coextensive with respect to segment 55 of blanket 40, and coverlet 76 of blanket 41 is substantially coextensive with respect to segment 56 of blanket 40.

Further in common with bedclothes apparatus 30, bedclothes apparatus 150 also shares the slide fastener assemblies forming fastener assemblies 100 and 101 illustrated in FIGS. 8 and 9. Fastener assemblies 100 and 101 are formed at gap 92 between marginal edges 90 and 91. Further, fastener assembly 100 is formed between marginal edge 90 of coverlet 75 of blanket 41 and central section 54 of blanket 40 to releasably connect marginal edge 90 of coverlet 75 of blanket 41 to central section 54 of blanket 40, and fastener assembly 101 is formed between marginal edge 91 of coverlet 76 of blanket 41 and central section 54 of blanket 40 to releasably connect marginal edge 91 of coverlet 76 of blanket 41 to central section 54 of blanket 40. Fastener assembly 100 runs along entire length of marginal edge 90 and gap 92, and fastener assembly 101 likewise runs along the entire length of marginal edge 91 and gap 92.

Having discussed the principal similarities between bedclothes apparatus 30 and bedclothes apparatus 150, the principle differences between bedclothes apparatus 30 and bedclothes apparatus 150 are formed in end panel 80 and fastener assemblies 100 and 101. In bedclothes apparatus 150, end panel 80 is severed along central section 74 of blanket 41 thereby separating coverlet 75 from coverlet 76 and dividing blanket 41 into two separate parts, namely, coverlet 75 and coverlet 76. Also fastener assembly 100 is fashioned with two sliders including slider 114 and slider 164, and fastener assembly 101 is fashioned with two sliders including slider 124 and slider 174.

The sliders 114 and 164, operated by hand, of fastener assembly 100 each moves along rows 112 and 113 of teeth and mesh together or separates rows 112 and 113 of teeth depending on the direction of movement. In the present embodiment, slider 114 meshes rows 112 and 113 of teeth together when moved in the direction indicated by arrowed line A in FIG. 8 toward end 70 of blanket 40, and separates rows 112 and 113 of teeth when moved in the direction indicated by the arrowed line B in FIG. 8 toward end 71 of blanket 41, whereas slider 164 meshes rows 112 and 113 of teeth together when moved in the direction indicated by arrowed line E in FIG. 8 toward end 71 of blanket 41, and separates rows 112 and 113 of teeth when moved in the direction indicated by the arrowed line F in FIG. 8 toward end 70 of blanket 41. The sliders 124 and 174, operated by hand, of slider assembly 101 each moves along rows 122 and 123 of teeth and meshes together or separates rows 122 and 123 of teeth depending on the direction of movement. According to the invention, slider 124 meshes rows 122 and 123 of teeth together when moved in the direction indicated by the arrowed line C in FIG. 8 toward end 70 of blanket 40, and separates rows 122 and 123 of teeth when moved in the direction indicated by the arrowed line D in FIG. 8 toward end 71 of blanket 41, whereas slider 174 meshes rows 122 and 123 of teeth together when moved in the direction indicated by arrowed line G in FIG. 8 toward end 71 of blanket 41, and separates rows 122 and 123 of teeth when moved in the direction indicated by the arrowed line H in FIG. 8 toward end 70 of blanket 41.

Figure 10:
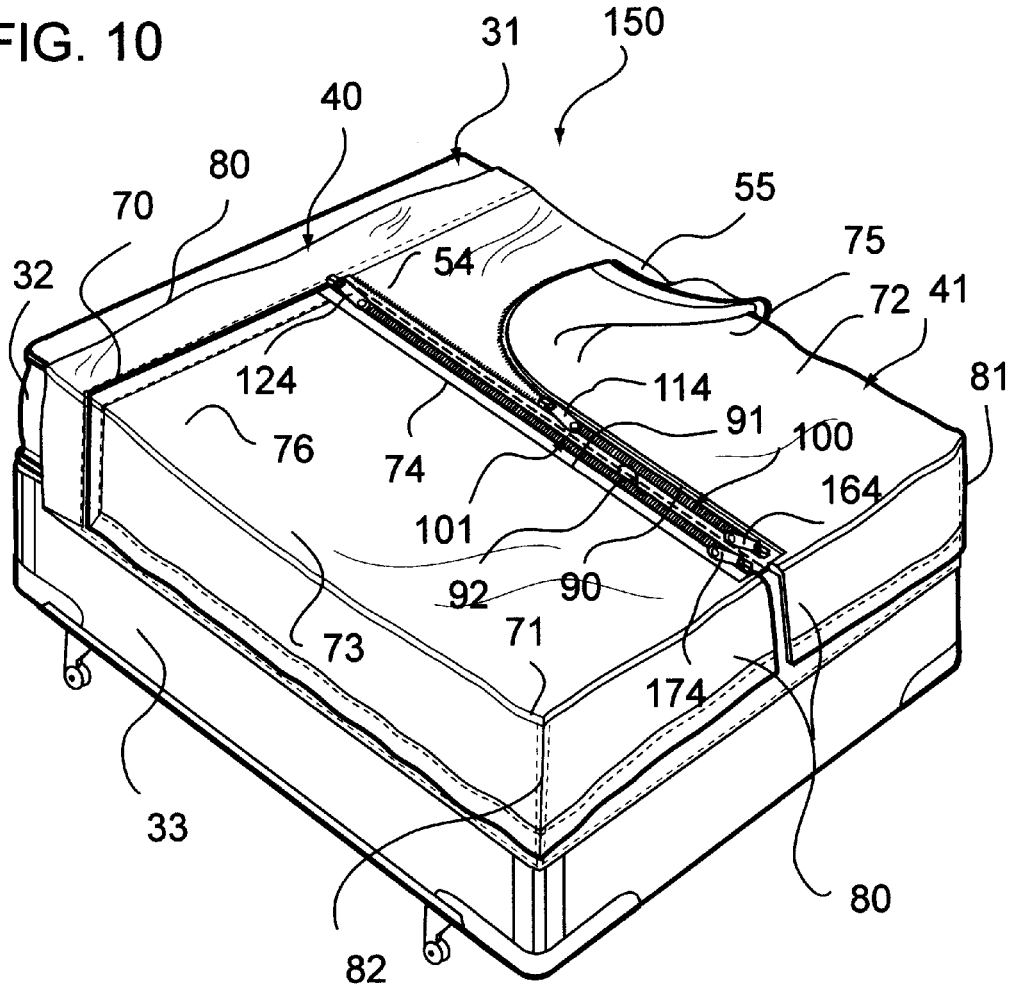
FIGS. 10-12 are perspective views illustrating different configurations of the bedclothes apparatus of FIG. 8 in use in conjunction with a bed.

As in bedclothes apparatus 30, fastener assembly 100 is operable independently of fastener assembly 101 to secure marginal edge 90 of coverlet 75 with respect to or otherwise to and along central section 54 of blanket 40 to allow coverlet 75 to be laid across segment 55 of blanket 40 as shown in FIG. 8, and to release marginal edge 90 of coverlet 75 from central section 54 as shown in FIG. 10 by sliding slider 114 toward end 71 of blanket 41 away from end 70 of blanket 41 to allow coverlet 75 from end 70 to be peeled, folded, or otherwise moved away from segment 55 of blanket 40 and central section 54 of blanket 40 from end 50 of blanket 40, such as when an occupant lying on mattress 32 under segment 55 is too hot and wishes to uncover himself from coverlet 75 from end 50 of blanket 40. Likewise, fastener assembly 101 operable independently of fastener assembly 100 to secure marginal edge 91 of coverlet 76 with respect to or otherwise to and along central section 54 of blanket 40 to allow coverlet 76 to be laid across segment 56 of blanket 40 as shown in FIGS. 1, 2, and 4, and to release marginal edge 91 of coverlet 76 from central section 54 by sliding slider 124 toward end 71 of blanket 41 away from end 70 of blanket 41 to allow coverlet 76 from end 70 to be peeled, folded, or otherwise moved away from segment 56 of blanket 40 and central section 54 of blanket 40 at end 50 of blanket 40 in exactly the same manner as described and shown in connection with coverlet 76, such as when an occupant lying on mattress 32 under segment 56 is too hot and wishes to uncover himself from coverlet 76. Coverlet 75 can be secured and released with respect to central section 54 of blanket 40 in this way independent of and without disturbing coverlet 76, and coverlet 76 can be secured and released with respect to central section of blanket 40 in this way as may be desired with respect to and without disturbing coverlet 75.

Figure 11:
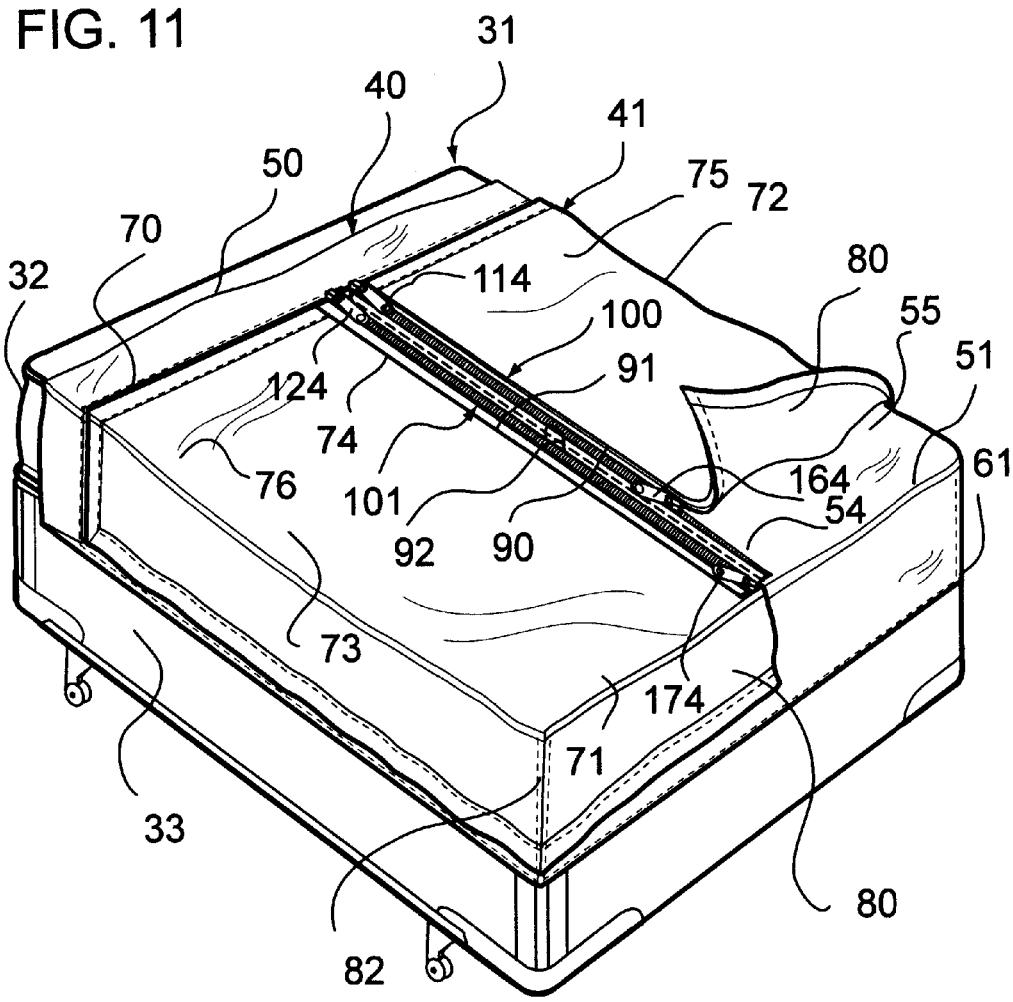

Unlike bedclothes apparatus 30, in bedclothes apparatus 150 fastener assembly 100 is operable independently of fastener assembly 101 to also release marginal edge 90 of coverlet 75 from central section 54 as shown in FIG. 11 by sliding slider 164 toward end 70 of blanket 41 away from end 71 of blanket 41 to allow coverlet 75 at end 71 to be peeled, folded, or otherwise moved away from segment 55 of blanket 40 and central section 54 of blanket 40 from end 51 of blanket 40, such as when an occupant lying on mattress 32 under segment 55 is too hot and wishes to uncover himself from coverlet 75 from end 50 of blanket 40. Because coverlet 75 is separate from coverlet 76, coverlet 75 can be arranged and moved in this way. Fastener assembly 101 is, likewise, operable independently of fastener assembly 100 to additionally release marginal edge 91 of coverlet 76 from central section 54 by sliding slider 124 toward end 70 of blanket 41 away from end 71 of blanket 41 to allow coverlet 76 from end 71 thereof to be peeled, folded, or otherwise moved away from segment 56 of blanket 40 and central section 54 of blanket 40 from end 51 of blanket 40 in exactly the same manner as described and shown in connection with coverlet 75, such as when an occupant lying on mattress 32 under segment 56 is too hot and wishes to uncover himself from coverlet 76 from end 51 of blanket 40. Because coverlet 76 is separate from coverlet 75, coverlet 76 can be arranged and moved in this way. Also, because strips 111 and 121 are affixed to each other and also to central section 54 of blanket 40 as shown and described in connection with FIG. 5, coverlet 75 of bedclothes apparatus 150 can be secured and released with respect to central section 54 of blanket 40 in the described manner independent of and without disturbing coverlet 76, and coverlet 76 of bedclothes apparatus 150 can be secured and released with respect to central section of blanket 40 in the described manner as may be desired with respect to and without disturbing coverlet 75.

Figure 12:
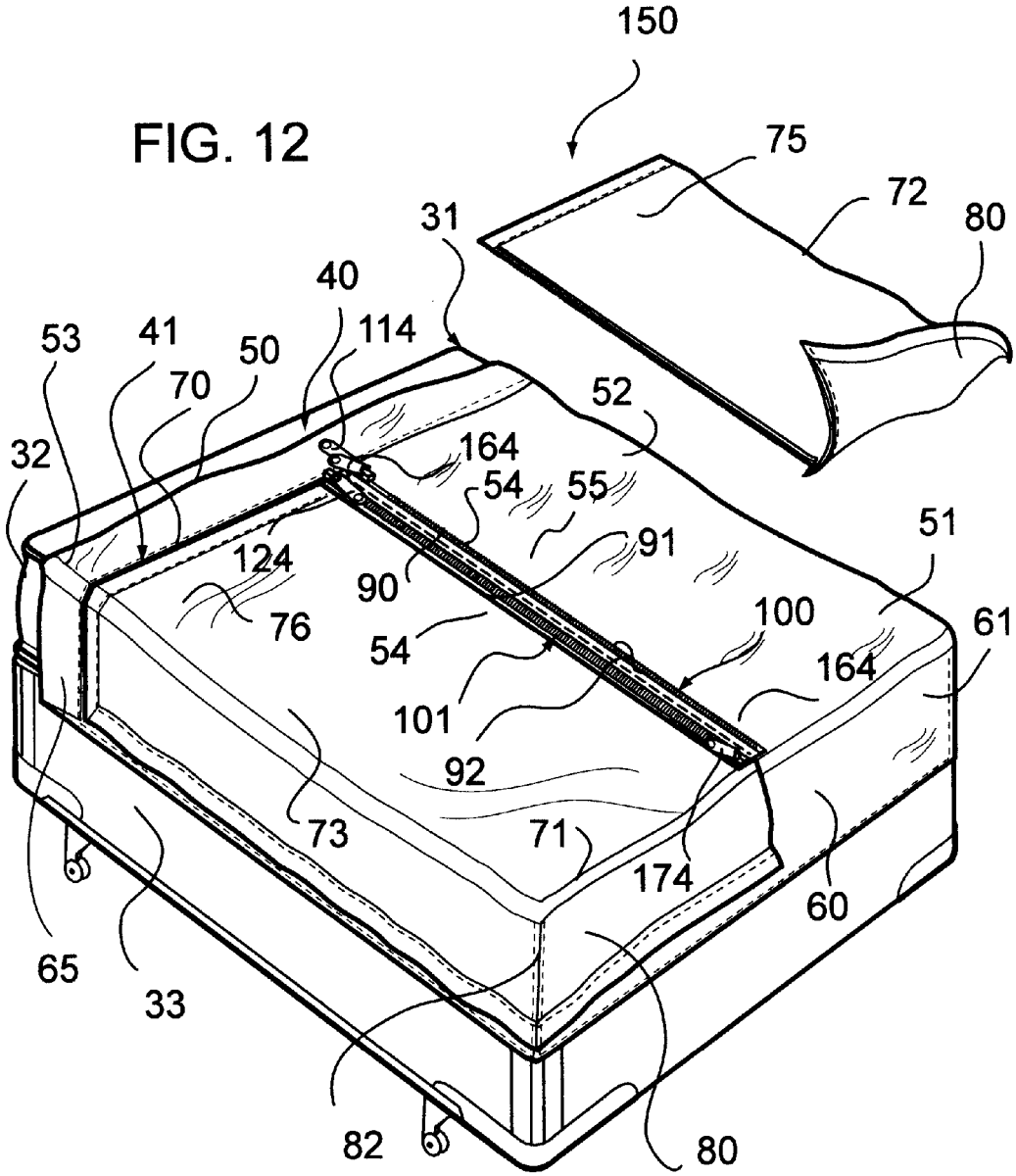

In a further use and configuration of bedclothes apparatus 150, fastener assembly 100 in bedclothes apparatus 150 is useful in completely detaching coverlet 75 from cover 40 as shown in FIG. 12, and fastener assembly 101 in bedclothes apparatus 150 is likewise useful in completely detaching coverlet 76 from cover 40. Coverlet 75 may be detached from cover 40 in two ways, including sliding slider 114 all the way from end 70 of blanket 41 to end 71 of blanket 41 to completely detach row 112 of teeth from row 113 of teeth to thereby completely detach marginal edge 90 of coverlet 75 from central section 54 of blanket 40, or by sliding slider 164 all the way from end 71 of blanket 41 to end 70 of blanket 41 to completely detach row 112 of teeth from row 113 of teeth to thereby completely detach marginal edge 90 of coverlet 75 from central section 54 of blanket 40. Coverlet 75 may be so detached in the instance in which use of coverlet 75 by a user lying under segment 55 of blanket 40 is not desired without disturbing coverlet 76 attached in place and which remains attached in place when coverlet 75 is completely detached. Coverlet 75 may be reattached to central section 54 of blanket 40 simply by re-zipping rows 112 and 113 of teeth back together with either slider 114 or slider 164, which is simply the reverse of the operation used to detach coverlet 75 from blanket 40. Because coverlet 75 is separate from coverlet 76, coverlet 75 can be arranged and moved in this way independent of coverlet 76.

As in bedclothes apparatus 30, in bedclothes apparatus 150 it is to be understood that with both coverlets 75 and 76 in their secured positions, movement of either coverlet 75 or 76 from its secured position to its released position through the operation of its respective fastener assembly will not disturb the other one of coverlets 75 and 76 from its secured position, in accordance with the principle of the invention, and this is dictated by the structure of the respectively fastener assemblies 100 and 101 and their attachment to, and structural association with, blankets 40 and 41.

As with coverlet 75, coverlet 76 may be detached from cover 40 in two ways, including sliding slider 124 all the way from end 70 of blanket 41 to end 71 of blanket 41 to completely detach row 122 of teeth from row 123 of teeth to thereby completely detach marginal edge 91 of coverlet 76 from central section 54 of blanket 40, or by sliding slider 174 all the way from end 71 of blanket 41 to end 70 of blanket 41 to completely detach row 122 of teeth from row 123 of teeth to thereby completely detach marginal edge 91 of coverlet 76 from central section 54 of blanket 40. Coverlet 76 may be so detached in the instance in which use of coverlet 76 by a user lying under segment 56 of blanket 40 is not desired without disturbing coverlet 75 attached in place and which remains attached in place when coverlet 76 is completely detached. Coverlet 76 may be reattached to central section 54 of blanket 40 simply by re-zipping rows 122 and 123 of teeth back together with either slider 124 or slider 174, which is simply the reverse of the operation used to detach coverlet 76 from blanket 40. Because coverlet 76 is separate from coverlet 75, coverlet 76 can be arranged and moved in this way independent of coverlet 75. Because coverlets 75 and 76 can each be detached as described, they can each be easily washed independently of each other, and, moreover, independently of cover 40, such as in a washing machine or by hand if so desired.

It is to be emphasized that the fitted configuration of end 71 of blanket 41 in bedclothes apparatus 150 helps in the operation of fastener assemblies 100 and 101 by effectively securing blanket 41 in place with respect to mattress 32 and thus stabilizing blanket 41 as sliders 114 and 164 in conjunction with coverlet 75 and sliders 124 and 174 in conjunction with coverlet 76 are moved back and forth to secure and release coverlets 75 and 76 during use of bedclothes apparatus 150 as herein specifically described. If desired, corners 61 and 62 and end 51 of blanket 40 can be formed with elastic as with well-known elastic fitted sheets to elastically fit end 51 of blanket 40 to mattress 32 to further secure end 51 of cover 40 to mattress 32 to prevent cover 40 from shifting during use of bedclothes apparatus 30 as shown in FIG. 7 in conjunction with bedclothes apparatus 30.

Blanket 40 and blanket 41 are each fitted blankets in the preferred embodiment. In alternate embodiments, blanket 40 can be unfitted and simply constructed as a broad flat blanket, and blanket 41 can be unfitted and simply constructed as a broad, flat blanket as discussed in connection with bedclothes apparatus 30.

Figure 13:
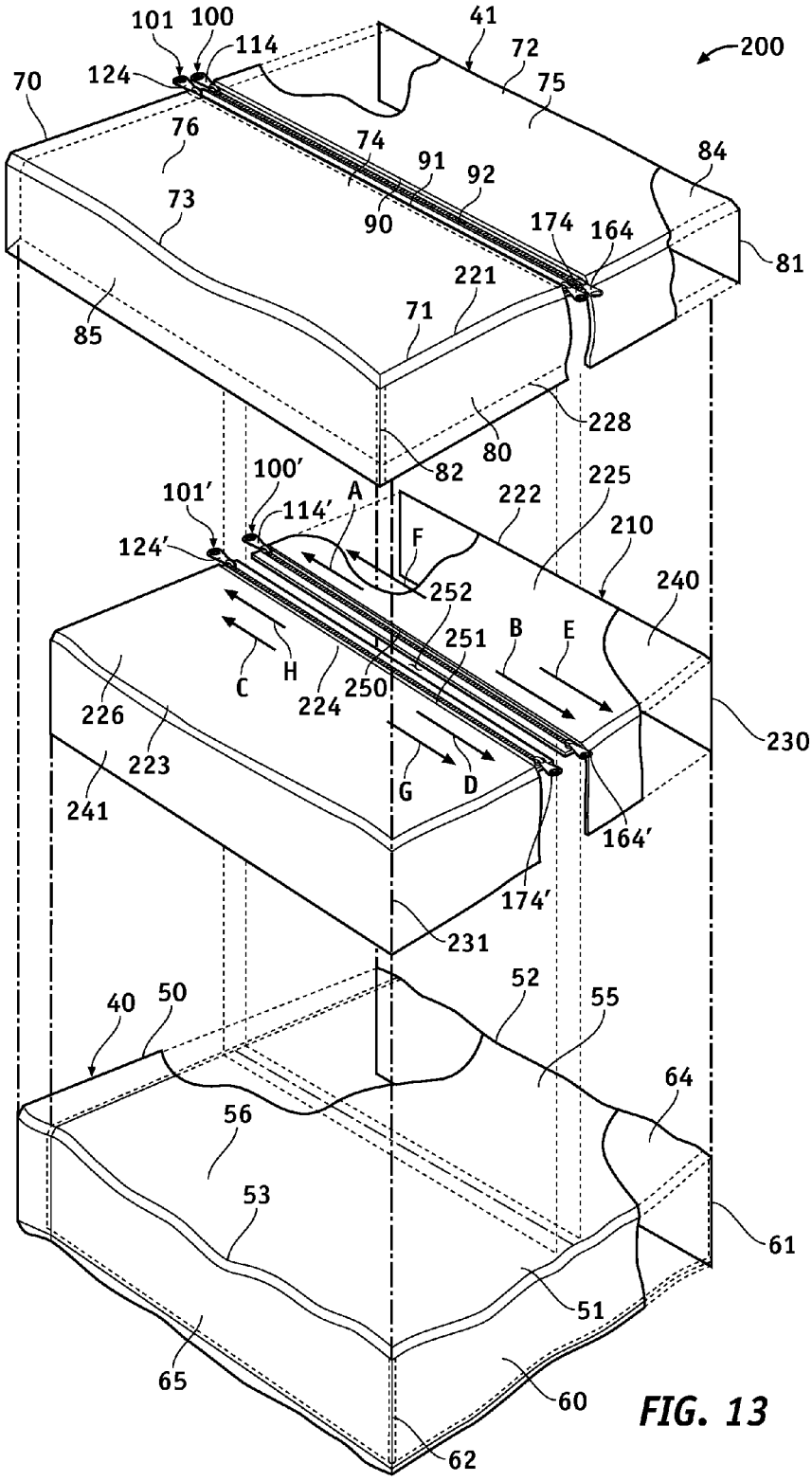
FIG. 13 is an exploded perspective view of an alternate embodiment of a bedclothes apparatus with portions of the bedclothes apparatus broken away for illustrative purposes, the bedclothes apparatus constructed and arranged in accordance with the principle of the invention.
Figure 14:
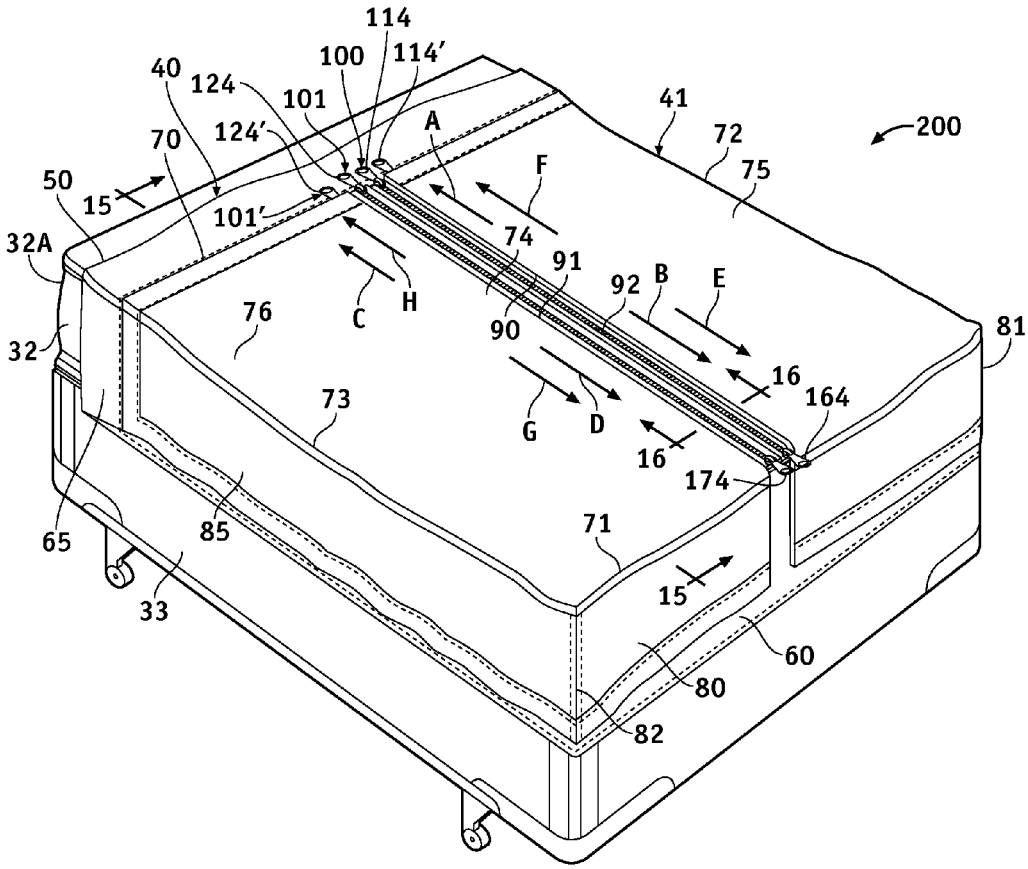
FIG. 14 is a perspective view of the bedclothes apparatus of FIG. 13 shown as it would appear assembled and installed on a bed.

Reference is now made to FIG. 13 in which there is seen an exploded perspective view of an alternate embodiment of a bedclothes apparatus 200 constructed and arranged in accordance with the principle of the invention, and to FIG. 14 illustrating bedclothes apparatus 200 as it would appear assembled and installed on bed 31 including mattress 32 and box springs 33. In common with bedclothes apparatus 150, bedclothes apparatus 200 is an assembly and, according to the principle of the invention, includes opposed, substantially coextensive blankets 40 and 41 each sized to cover two occupants of bed 31. Blanket 40 is a lower or inner blanket of bedclothes apparatus 200, and blanket 41 is an upper or outer blanket of bedclothes apparatus 200. Blanket 41 is positioned over blanket 40, which is positioned upon mattress 32 as illustrated in FIGS. 13 and 14, and also FIG. 15, which is a sectional view taken along line 15-15 of FIG. 14.

Figure 15:
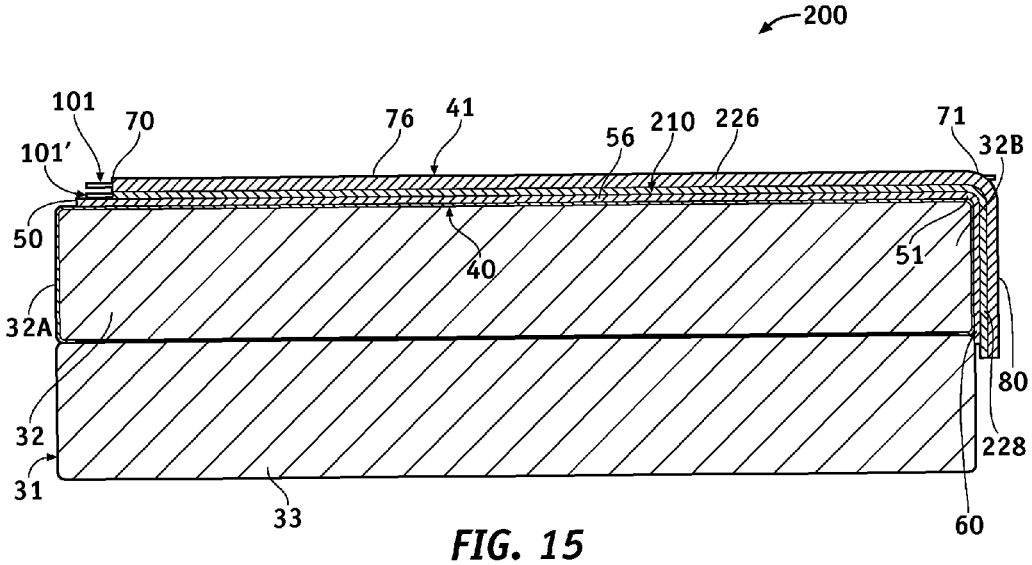
FIG. 15 is a section view taken along line 15-15 of FIG. 14.

In common with bedclothes apparatus 150, bedclothes apparatus 200, as illustrated in FIG. 13, shares blanket 40 having opposed ends 50 and 51, opposed sides 52 and 53, and central section 54 between opposed sides 52 and 53 extending from end 50 of blanket 40 to end 51 of blanket 40, which divides blanket 40 in two opposed substantially equal sides, halves or segments 55 and 56. First half or segment 55 of blanket 40 extends from central section 54 to side 52 of blanket 40 and from and between end 50 of blanket 40 to end 51 of blanket 40 to cover an occupant lying on one side of mattress 32, and second half or segment 56 of blanket 40 extends from central section 54 to side 53 of blanket 40 and from and between end 50 of blanket 40 to end 51 of blanket 40 to cover another occupant lying on the other side of mattress 32. Blanket 40 in bedclothes apparatus 200 is a fitted blanket in that it is structured to fit about mattress 32 as shown in FIGS. 14 and 15. In common with blanket 40 in bedclothes apparatus 150, blanket 40 in bedclothes apparatus 200 further shares end panel 60 extending between opposed corners 61 and 62 formed in end 51 of blanket 40 at sides 52 and 53, respectively, side 52 of blanket 40 formed with side panel 64 extending from corner 61 to end 50 of blanket 40, and side 53 of blanket 40 formed with side panel 65 extending from corner 62 to end 50 of blanket 40. Side panel 64 and the portion of end panel 60 extending generally from central section 54 to corner 61 can be considered part of or otherwise an extension of the one side half or segment 55 of blanket 40, and side panel 65 and the portion of end panel 60 extending generally from central section 54 to corner 62 can be considered part of or otherwise an extension of the other side or half or segment 56 of blanket 40. End 50 of blanket 40 is the upper end of blanket 40 designed to be positioned at head 32A of mattress 32 denoted in FIG. 14, and end 51 is designed to be positioned at the opposed foot 32B of mattress 32 as discussed on conjunction with bedclothes apparatus 150 and as shown in FIG. 15, in which the fitted construction of blanket 40 is provided such that corners 61 and 62 fit downwardly about the opposed corners on either side of foot 32B of mattress 32 and end panel 60 extends downwardly and across foot 32B of mattress 32 between corners 61 and 62, side panel 64 extends downwardly and across one side of mattress 32 from corner 61 to end 50 of blanket 40, and side panel 65 extends downwardly and across the opposed side of mattress 32 from corner 62 to end 50 of blanket 40.

Referencing FIGS. 13 and 14 in relevant part, further in common with bedclothes apparatus 150, bedclothes apparatus 200 shares blanket 41 including opposed ends 70 and 71, opposed sides 72 and 73, and central section 74 between opposed sides 72 and 73 extending from end 70 of blanket 41 to end 71 of blanket 41 dividing blanket 71 in two opposed substantially equal coverlets 75 and 76. The first coverlet 75 of blanket 41 extends from central section 74 to side 72 of blanket 41 and from and between end 70 of blanket 41 to end 71 of blanket 41. The second coverlet 76 of blanket 41 extends from central section 74 to side 73 of blanket 41 and from and between end 70 of blanket 41 to end 71 of blanket 41. Blanket 41 is positioned atop blanket 40, in which coverlet 75 extends over and across segment 55 of blanket 40, coverlet 76 extends over and across segment 56 of blanket 40, end 70 of blanket 41 extends over across blanket 40 adjacent to end 50 of blanket 40, end 71 of blanket 41 extends over and across blanket adjacent to end 51 of blanket 40 and end panel 80 extends over and across end panel 60, side 72 of blanket 41 extends over and across side 52 of blanket 40 and side panel 84 extends over and across side panel 64 of blanket 40, and side 73 of blanket 41 extends over and across side 53 of blanket 40 and side panel 85 extends over and across side panel 65 of blanket 40.

Like blanket 40, blanket 41 in bedclothes apparatus 200 is, as in bedclothes apparatus 150, a fitted blanket in that it is structured to fit about blanket 40 fitted about mattress 32. In characterizing the fitted construction of blanket 41, end 71 of blanket 41 is constructed with end panel 80 extending between opposed corners 81 and 82 formed in end 71 of blanket 41 at sides 72 and 73, respectively, side 72 of blanket 41 is formed with side panel 84 extending from corner 81 to end 70 of blanket 41, and side 73 of blanket 41 is formed with side panel 85 extending from corner 82 to end 70 of blanket 41. Side panel 84 and the portion of end panel 80 extending generally from central section 74 to corner 81 can be considered part of or otherwise an extension of coverlet 75 of blanket 41, and side panel 85 and the portion of end panel 80 extending generally from central section 74 to corner 82 can be considered part of or otherwise an extension of coverlet 76 of blanket 41. End 70 of blanket 41 is the upper end of blanket 41 designed to be positioned at head 32A of mattress 32 denoted in FIG. 14, and end 71 is designed to be positioned at the opposed foot 32B of mattress 32 as shown in FIG. 15, in which the fitted construction of blanket 41 is provided such that corners 81 and 82 fit downwardly about the opposed corners of mattress 32 on either side of foot 32B of mattress 32 and end panel 80 extends downwardly and across foot 32B of mattress 32 between corners 81 and 82, side panel 84 extends downwardly and across one side of mattress 32 from corner 81 to end 50 of blanket 40, and side panel 85 extends downwardly and across the opposed side of mattress 32 from corner 82 to end 50 of blanket 40, as explained in connection with bedclothes apparatus 150.

Blanket 41 of bedclothes apparatus 200 is, as with blanket 41 in bedclothes apparatus 150, severed along central section 74 from end 70 of blanket to a point proximate to and just inboard of end 71 of blanket 41 forming opposed, parallel marginal edges 90 and 91 in blanket 41 and gap 92 therebetween, and further forming coverlet 75 of blanket 41 extending from marginal edge 90 on one side of gap 92 to side 72 of blanket 41 and between ends 70 and 71 blanket 41, and coverlet 76 of blanket 41 extending from marginal edge 91 on the opposed side of gap 92 to side 73 of blanket 41 and between ends 70 and 71 blanket 41. Segment 55 of blanket 40 is substantially coextensive with respect to segment 56 of blanket 40, coverlet 75 of blanket 41 is substantially coextensive with respect to coverlet 76 of blanket 41, coverlet 75 of blanket 41 is substantially coextensive with respect to segment 55 of blanket 40, and coverlet 76 of blanket 41 is substantially coextensive with respect to segment 56 of blanket 40.

Further in common with bedclothes apparatus 150, bedclothes apparatus 200 also shares the slide fastener assemblies forming fastener assemblies 100 and 101 illustrated in FIGS. 8 and 9. Fastener assemblies 100 and 101 are formed at gap 92, and are coupled between central section 54 and marginal edges 90 and 91. Further, fastener assembly 100 is formed between marginal edge 90 of coverlet 75 of blanket 41 and central section 54 of blanket 40 to releasably connect marginal edge 90 of coverlet 75 of blanket 41 to central section 54 of blanket 40, and fastener assembly 101 is formed between marginal edge 91 of coverlet 76 of blanket 41 and central section 54 of blanket 40 to releasably connect marginal edge 91 of coverlet 76 of blanket 41 to central section 54 of blanket 40. Fastener assembly 100 runs along entire length of marginal edge 90 and gap 92, and fastener assembly 101 likewise runs along the entire length of marginal edge 91 and gap 92.

In bedclothes apparatus 200, as with bedclothes apparatus 150, end panel 80 is severed along central section 74 of blanket 41 thereby separating coverlet 75 from coverlet 76 and dividing blanket 41 into two separate parts, namely, coverlet 75 and coverlet 76. Also fastener assembly 100 is fashioned with two sliders including slider 114 and slider 164, and fastener assembly 101 is fashioned with two sliders including slider 124 and slider 174.

The sliders 114 and 164, operated by hand, of fastener assembly 100 each moves along the rows of teeth of fastener assembly 100 and mesh together or separates the rows of teeth depending on the direction of movement. In the present embodiment, slider 114 meshes the rows of teeth together when moved in the direction indicated by arrowed line A in FIG. 14 toward end 70 of blanket 40, and separates the rows of teeth when moved in the direction indicated by the arrowed line B in FIG. 14 toward end 71 of blanket 41, whereas slider 164 of fastener assembly 100 meshes the rows of teeth together when moved in the direction indicated by arrowed line E in FIG. 14 toward end 71 of blanket 41, and separates the rows of teeth of fastener assembly 100 when moved in the direction indicated by the arrowed line F in FIG. 14 toward end 70 of blanket 41. The sliders 124 and 174, operated by hand, of slider assembly 101 each moves along the corresponding rows of teeth and meshes together or separates the rows of teeth of fastener assembly 101 depending on the direction of movement. According to the invention, slider 124 meshes the rows of teeth of fastener assembly 101 together when moved in the direction indicated by the arrowed line C in FIG. 14 toward end 70 of blanket 40, and separates the rows of teeth of fastener assembly 101 when moved in the direction indicated by the arrowed line D in FIG. 14 toward end 71 of blanket 41, whereas slider 174 meshes the rows of teeth of fastener assembly 101 together when moved in the direction indicated by arrowed line G in FIG. 14 toward end 71 of blanket 41, and separates rows the rows of teeth of fastener assembly 101 when moved in the direction indicated by the arrowed line H in FIG. 14 toward end 70 of blanket 41.

Figure 17:
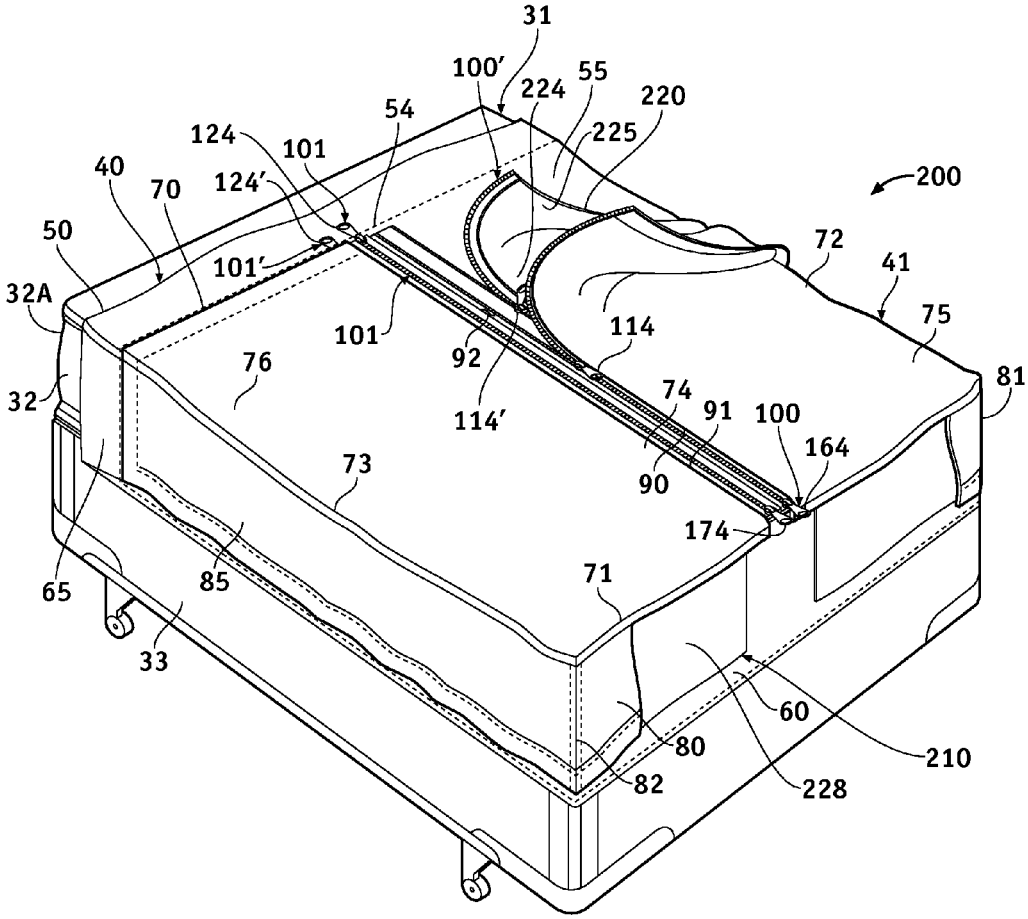
FIGS. 17-19 are perspective views illustrating different configurations of the bedclothes apparatus of FIG. 13 in use in conjunction with a bed.

As in bedclothes apparatus 150, fastener assembly 100 of bedclothes apparatus 200 is operable independently of fastener assembly 101 to secure marginal edge 90 of coverlet 75 with respect to or otherwise to and along central section 54 of blanket 40 to allow coverlet 75 to be laid across segment 55 of blanket 40 as shown in FIG. 14, and to release marginal edge 90 of coverlet 75 from central section 54 as shown in FIG. 17 by sliding slider 114 toward end 71 of blanket 41 away from end 70 of blanket 41 to allow coverlet 75 from end 70 to be peeled, folded, or otherwise moved away from segment 55 of blanket 40 and central section 54 of blanket 40 from end 50 of blanket 40, such as when an occupant lying on mattress 32 under segment 55 is too hot and wishes to uncover himself from coverlet 75 from end 50 of blanket 40. Likewise, fastener assembly 101 is operable independently of fastener assembly 100 to secure marginal edge 91 of coverlet 76 with respect to or otherwise to and along central section 54 of blanket 40 to allow coverlet 76 to be laid across segment 56 of blanket 40 as shown in FIGS. 1, 2, and 4, and to release marginal edge 91 of coverlet 76 from central section 54 by sliding slider 124 toward end 71 of blanket 41 away from end 70 of blanket 41 to allow coverlet 76 from end 70 to be peeled, folded, or otherwise moved away from segment 56 of blanket 40 and central section 54 of blanket 40 at end 50 of blanket 40 in exactly the same manner as described and shown in connection with coverlet 75, such as when an occupant lying on mattress 32 under segment 56 is too hot and wishes to uncover himself from coverlet 76. Coverlet 75 can be secured and released with respect to central section 54 of blanket 40 in this way independent of and without disturbing coverlet 76, and coverlet 76 can be secured and released with respect to central section of blanket 40 in this way as may be desired with respect to and without disturbing coverlet 75.

Figure 18:
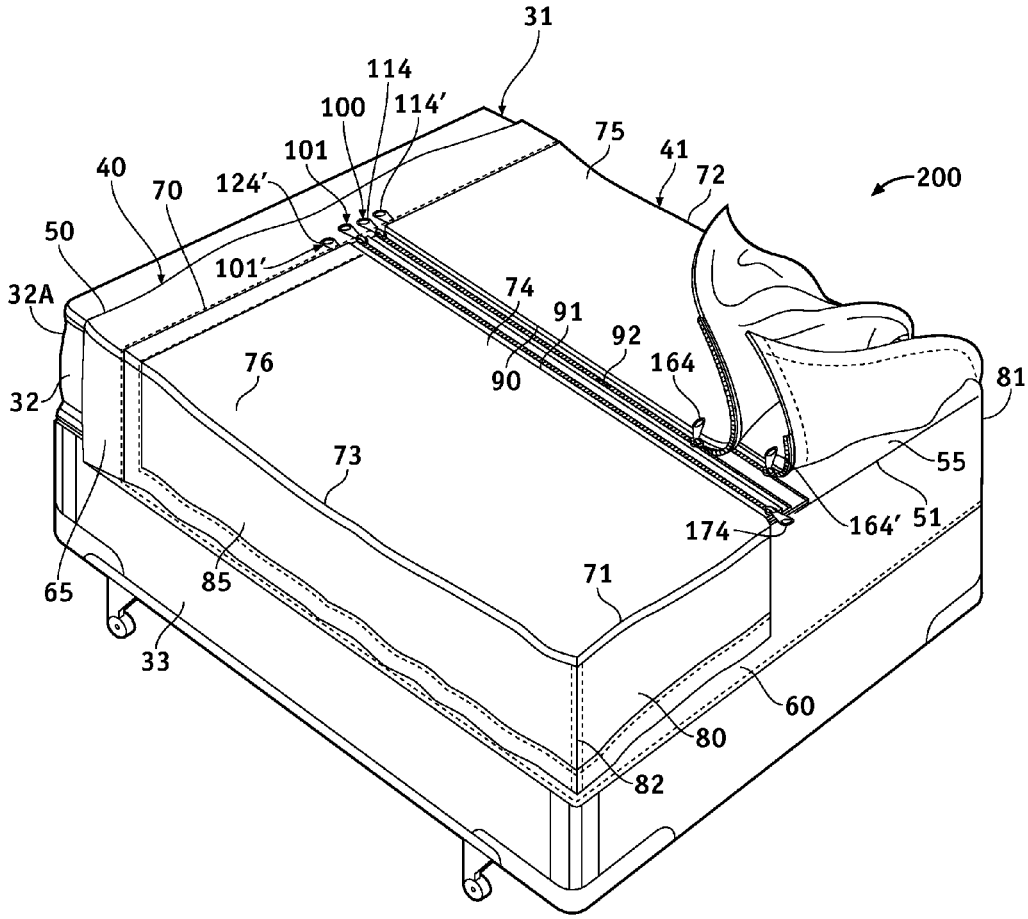

Like bedclothes apparatus 150, in bedclothes apparatus 200 fastener assembly 100 is operable independently of fastener assembly 101 to also release marginal edge 90 of coverlet 75 from central section 54 as shown in FIG. 18 by sliding slider 164 toward end 70 of blanket 41 away from end 71 of blanket 41 to allow coverlet 75 at end 71 to be peeled, folded, or otherwise moved away from segment 55 of blanket 40 and central section 54 of blanket 40 from end 51 of blanket 40, such as when an occupant lying on mattress 32 under segment 55 is too hot and wishes to uncover himself from coverlet 75 from end 50 of blanket 40. Because coverlet 75 is separate from coverlet 76, coverlet 75 can be arranged and moved in this way. Fastener assembly 101 is, likewise, operable independently of fastener assembly 100 to additionally release marginal edge 91 of coverlet 76 from central section 54 by sliding slider 124 toward end 70 of blanket 41 away from end 71 of blanket 41 to allow coverlet 76 from end 71 thereof to be peeled, folded, or otherwise moved away from segment 56 of blanket 40 and central section 54 of blanket 40 from end 51 of blanket 40 in exactly the same manner as described and shown in connection with coverlet 75, such as when an occupant lying on mattress 32 under segment 56 is too hot and wishes to uncover himself from coverlet 76 from end 51 of blanket 40. Because coverlet 76 is separate from coverlet 75, coverlet 76 can be arranged and moved in this way. Also, because strips 111 and 121 are affixed to each other and also to central section 54 of blanket 40 as shown and described in connection with FIG. 5, coverlet 75 of bedclothes apparatus 150 can be secured and released with respect to central section 54 of blanket 40 in the described manner independent of and without disturbing coverlet 76, and coverlet 76 of bedclothes apparatus 150 can be secured and released with respect to central section of blanket 40 in the described manner as may be desired with respect to and without disturbing coverlet 75.

Figure 19:
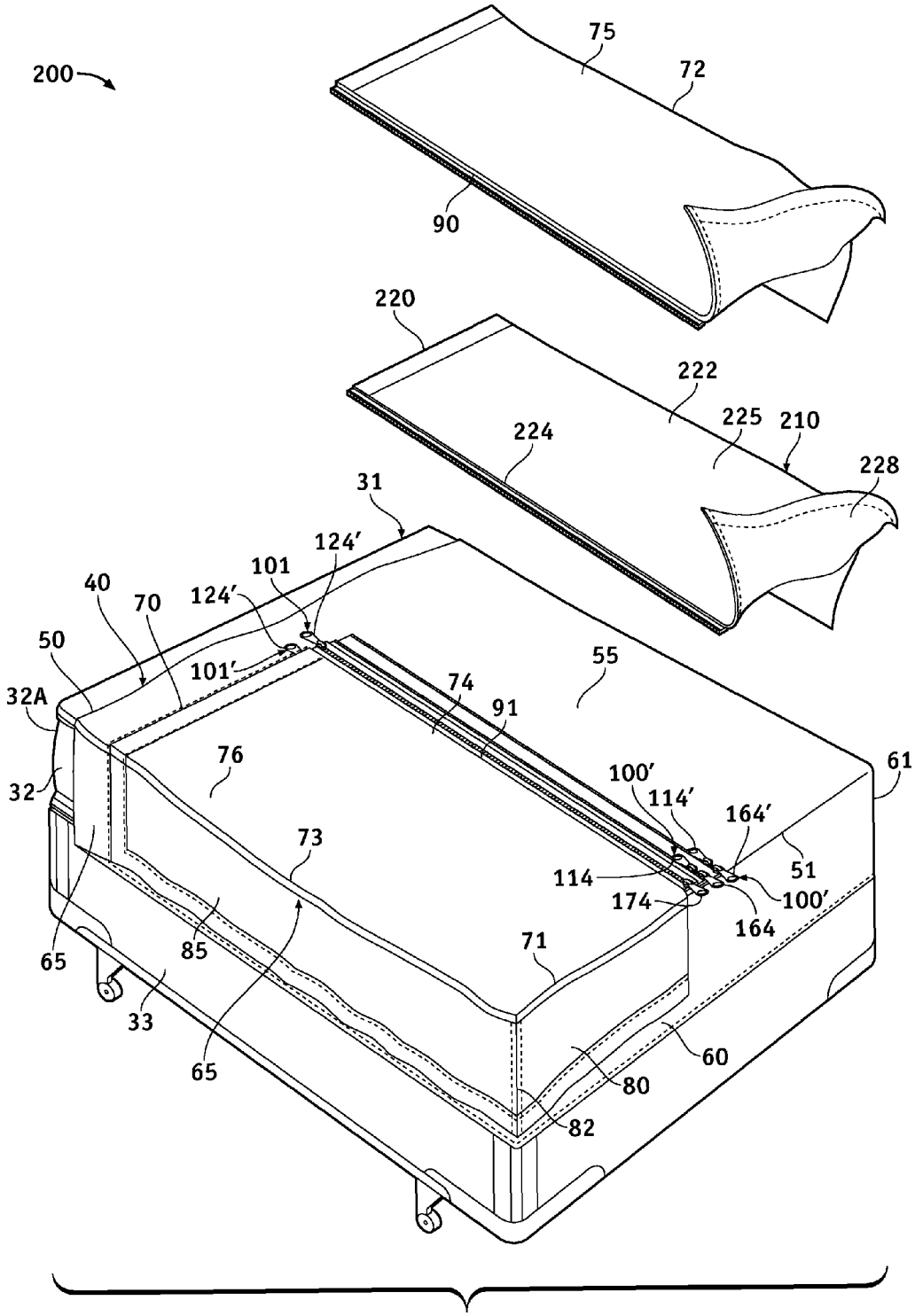

In a further use and configuration of bedclothes apparatus 200 as in bedclothes apparatus 150, fastener assembly 100 in bedclothes apparatus 200 is useful in completely detaching coverlet 75 from cover 40 as shown in FIG. 19, and fastener assembly 101 in bedclothes apparatus 150 is likewise useful in completely detaching coverlet 76 from cover 40. Coverlet 75 may be detached from cover 40 in two ways, including sliding slider 114 all the way from end 70 of blanket 41 to end 71 of blanket 41 to completely detach the rows of teeth of fastener assembly 100 to thereby completely detach marginal edge 90 of coverlet 75 from central section 54 of blanket 40, or by sliding slider 164 all the way from end 71 of blanket 41 to end 70 of blanket 41 to completely detach rows of teeth of fastener assembly 100 to thereby completely detach marginal edge 90 of coverlet 75 from central section 54 of blanket 40. Coverlet 75 may be so detached in the instance in which use of coverlet 75 by a user lying under segment 55 of blanket 40 is not desired without disturbing coverlet 76 attached in place and which remains attached in place when coverlet 75 is completely detached. Coverlet 75 may be reattached to central section 54 of blanket 40 simply by re-zipping the rows of teeth of fastener assembly 100 back together with either slider 114 or slider 164, which is simply the reverse of the operation used to detach coverlet 75 from blanket 40. Because coverlet 75 is separate from coverlet 76, coverlet 75 can be arranged and moved in this way independent of coverlet 76.

As in bedclothes apparatus 150, in bedclothes apparatus 200 it is to be understood that with both coverlets 75 and 76 in their secured positions, movement of either coverlet 75 or 76 from its secured position to its released position through the operation of its respective fastener assembly will not disturb the other one of coverlets 75 and 76 from its secured position, in accordance with the principle of the invention, and this is dictated by the structure of the respectively fastener assemblies 100 and 101 and their attachment to, and structural association with, blankets 40 and 41.

As with coverlet 75, coverlet 76 may be detached from cover 40 in two ways, including sliding slider 124 all the way from end 70 of blanket 41 to end 71 of blanket 41 to completely detach the rows of teeth of fastener assembly 101 to thereby completely detach marginal edge 91 of coverlet 76 from central section 54 of blanket 40, or by sliding slider 174 all the way from end 71 of blanket 41 to end 70 of blanket 41 to completely detach the rows of teeth of fastener assembly 101 to thereby completely detach marginal edge 91 of coverlet 76 from central section 54 of blanket 40. Coverlet 76 may be so detached in the instance in which use of coverlet 76 by a user lying under segment 56 of blanket 40 is not desired without disturbing coverlet 75 attached in place and which remains attached in place when coverlet 76 is completely detached. Coverlet 76 may be reattached to central section 54 of blanket 40 simply by re-zipping the rows of teeth of fastener assembly 101 back together with either slider 124 or slider 174, which is simply the reverse of the operation used to detach coverlet 76 from blanket 40. Because coverlet 76 is separate from coverlet 75, coverlet 76 can be arranged and moved in this way independent of coverlet 75. Because coverlets 75 and 76 can each be detached as described, they can each be easily washed independently of each other, and, moreover, independently of cover 40, such as in a washing machine or by hand if so desired.

As in bedclothes apparatus 150, in bedclothes apparatus 200 it is to be emphasized that the fitted configuration of end 71 of blanket 41 in bedclothes apparatus 200 helps in the operation of fastener assemblies 100 and 101 by effectively securing blanket 41 in place with respect to mattress 32 and thus stabilizing blanket 41 as sliders 114 and 164 in conjunction with coverlet 75 and sliders 124 and 174 in conjunction with coverlet 76 are moved back and forth to secure and release coverlets 75 and 76 during use of bedclothes apparatus 150 as herein specifically described. If desired, corners 61 and 62 and end 51 of blanket 40 can be formed with elastic as with well-known elastic fitted sheets to elastically fit end 51 of blanket 40 to mattress 32 to further secure end 51 of cover 40 to mattress 32 to prevent cover 40 from shifting during use of bedclothes apparatus 30 as shown in FIG. 7 in conjunction with bedclothes apparatus 30. Blanket 40 and blanket 41 are each fitted blankets in the preferred embodiment. In alternate embodiments, blanket 40 can be unfitted and simply constructed as a broad flat blanket, and blanket 41 can be unfitted and simply constructed as a broad, flat blanket as discussed in connection with bedclothes apparatus 30.

Blanket 40 is used underneath blanket 41 formed by coverlets 75 and 76. As such, blanket 41 is preferably constructed to be thicker and/or warmer with respect to blanket 40. Blanket 40 is preferably a sheet, namely, a top sheet under which a user sleeps, and blanket 41 is preferably formed as a thicker and/or warmer blanket, such as a quilt, duvet, comforter, or the like, that is laid atop blanket 40 for warmth. In this regard, blanket 40 being a sheet has a warmth characteristic, blanket 41 being a quilt, duvet, comforter, or the like, has a warmth characteristic that is greater than the warmth characteristic of blanket 40.

According to the principle of the invention, bedclothes apparatus 200 incorporates an additional blanket 210. Blankets 40 and 41 are substantially coextensive and are each sized to cover two occupants of bed 31, and blanket 210 is substantially coextensive with respect to blankets 40 and 41 and is thus also sized to cover two occupants of bed 31. Blanket 210 is positioned between blanket 41, formed by coverlets 75 and 76, respectively, and blanket 40. Blanket 210 is an intermediate blanket positioned between, on the one hand, blanket 40, and, on the other hand, blanket 41 formed by coverlets 75 and 76. Blanket 41 is preferably constructed to be thicker and/or warmer with respect to not only blanket 40 but also blanket 210. Blanket 210 is positioned under blanket 41 and atop blanket 40 under which a user sleeps to provide additional warm. Blanket 41 is preferably formed as a thicker and/or warmer blanket, such as a quilt, duvet, comforter, or the like, that is laid atop blanket 210 for warmth. Blanket 210 is preferably formed as a thicker and/or warmer blanket relative to blanket 40 that is laid atop blanket 40 for additional warmth, and is preferably less thicker and/or warmer than blanket 41. In this regard, blanket 40 being a sheet has a warmth characteristic, blanket 41 being a quilt, duvet, comforter, or the like, has a warmth characteristic that is greater than the warmth characteristic of blanket 40 and also blanket 210, and blanket 210 being formed of cotton or microfiber material or the like has a warmth characteristic that is greater than the warmth characteristic of blanket 40 but that is less than the warmth characteristic of blanket 41. The inclusion of blanket 210 in bedclothes apparatus 200 provides additional warmth or comfort when required.

Referencing FIG. 13, blanket 210 includes opposed ends 220 and 221, opposed sides 222 and 223, and a central section 224 between opposed sides 222 and 223 extending from end 220 of blanket 210 to end 221 of blanket 210 dividing blanket 210 in two opposed substantially equal coverlets 225 and 226. The first coverlet 225 of blanket 210 is substantially coextensive with respect to coverlet 75 and extends from central section 224 to side 222 of blanket 210 and from and between end 220 of blanket 210 to end 221 of blanket 210. The second coverlet 226 of blanket 210 is substantially coextensive with respect to coverlet 76 and extends from central section 224 to side 223 of blanket 210 and from and between end 220 of blanket 210 to end 221 of blanket 210. Blanket 210 is positioned atop blanket 40 positioned atop mattress 32 and also under blanket 41, in which coverlet 225 extends over and across segment 55 of blanket 40, coverlet 226 extends over and across segment 56 of blanket 40, coverlet 75 extends over and across coverlet 225 of blanket 210, coverlet 76 extends over and across coverlet 226 of blanket 210, end 220 of blanket 210 extends over across blanket 40 adjacent to end 50 of blanket 40, end 221 of blanket 210 extends over and across blanket 40 adjacent to end 51 of blanket 40 and end panel 228 of blanket 210 extends over and across end panel 60 of blanket 40, side 222 of blanket 210 extends over and across side 52 of blanket 40 and a side panel 240 of blanket 210 extends over and across side panel 64 of blanket 40, and side 223 of blanket 210 extends over and across side 53 of blanket 40 and a side panel 241 of blanket 210 extends over and across side panel 65 of blanket 40.

Blanket 210 in bedclothes apparatus 200 is a fitted blanket in that it is structured to fit about blanket 40 fitted about mattress 32. In characterizing the fitted construction of blanket 210, end 221 of blanket 41 is constructed with end panel 228 extending between opposed corners 230 and 231 formed in end 221 of blanket 210 at sides 222 and 223, respectively, side 222 of blanket 210 is formed with side panel 240 extending from corner 230 to end 220 of blanket 210, and side 223 of blanket 210 is formed with side panel 241 extending from corner 231 to end 220 of blanket 210. Side panel 240 and the portion of end panel 228 extending generally from central section 224 to corner 230 can be considered part of or otherwise an extension of coverlet 225 of blanket 210, and side panel 241 and the portion of end panel 228 extending generally from central section 224 to corner 231 can be considered part of or otherwise an extension of coverlet 226 of blanket 210. End 220 of blanket 210 is the upper end of blanket 210 designed to be positioned at head 32A of mattress 32 denoted in FIG. 14, and end 221 is designed to be positioned at the opposed foot 32B of mattress 32 as shown in FIG. 15, in which the fitted construction of blanket 210 is provided such that corners 230 and 231 fit downwardly over blanket 40 about the opposed corners of mattress 32 on either side of foot 32B of mattress 32 and end panel 228 extends over end panel 60 of blanket 40 downwardly and across foot 32B of mattress 32 (see FIG. 15) between corners 230 and 231, side panel 240 extends downward over side panel 61 of blanket 40 and across one side of mattress 32 from corner 230 to end 220 of blanket 221, and side panel 241 extends downwardly over side panel 65 of blanket 40 and across the opposed side of mattress 32 from corner 231 to end 220 of blanket 210.

Blanket 210 of bedclothes apparatus 200 is severed along central section 224 from end 220 of blanket 210 to end 221 of blanket 210 forming opposed, parallel marginal edges 250 and 251 in blanket 210 and gap 252 therebetween, and further forming coverlet 225 of blanket 210 extending from marginal edge 250 on one side of gap 252 to side 222 of blanket 210 and between ends 220 and 221 of blanket 210, and coverlet 226 of blanket 210 extending from marginal edge 251 on the opposed side of gap 252 to side 223 of blanket 210 and between ends 220 and 221 of blanket 41. Segment 55 of blanket 40 is substantially coextensive with respect to segment 56 of blanket 40, coverlet 225 of blanket 210 is substantially coextensive with respect to coverlet 226 of blanket 41, coverlet 225 of blanket 210 is substantially coextensive with respect to segment 55 of blanket 40, coverlet 226 of blanket 210 is substantially coextensive with respect to segment 56 of blanket 40, coverlet 225 of blanket 210 is substantially coextensive with respect to coverlet 75 of blanket 41, and coverlet 226 of blanket 210 is substantially coextensive with respect to coverlet 76 of blanket 41.

Figure 16:
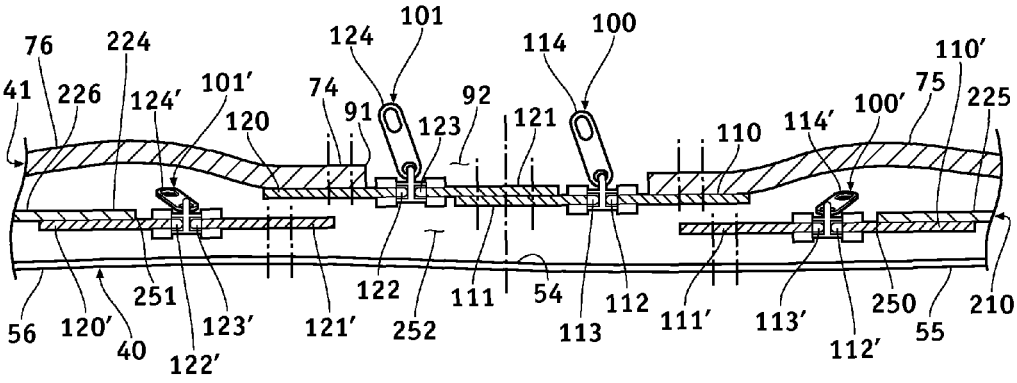
FIG. 16 is a section view taken along line 16-16 of FIG. 14.

Like blanket 41, blanket 210 shares the slide fastener assemblies forming fastener assemblies 100 and 101 as shown in FIG. 13. In connection with blanket 210, fastener assemblies 100 and 101 are identical to fastener assemblies 100 and 101 of blanket 41 and include the same elements. For ease of reference, the reference characters of fastener assemblies 100 and 101 in connection with blanket 210 include prime ("") symbols. Fastener assemblies 100' and 101' of blanket 210 are formed at gap 252 between central section 54 of blanket 40, and marginal edges 250 and 251. Further, fastener assembly 100' is formed between marginal edge 250 of coverlet 225 of blanket 210 and central section 54 of blanket 40 as seen in FIG. 16 to releasably connect marginal edge 250 of coverlet 225 of blanket 210 to central section 54 of blanket 40, and fastener assembly 101' is formed between marginal edge 251 of coverlet 226 of blanket 210 and central section 54 of blanket 40 to releasably connect marginal edge 251 of coverlet 226 of blanket 210 to central section 54 of blanket 40. Fastener assembly 100' runs along entire length of marginal edge 250 and gap 252, and fastener assembly 101' likewise runs along the entire length of marginal edge 251 and gap 252. End panel 228 is severed along central section 224 of blanket 210 thereby separating coverlet 225 from coverlet 226 and dividing blanket 210 into two separate parts, namely, coverlet 225 and coverlet 226. Also fastener assembly 100' is fashioned with two sliders including slider 114' and slider 164', and fastener assembly 101' is fashioned with two sliders including slider 124' and slider 174', as referenced in FIG. 13.

Looking to FIG. 16, which is a sectional view taken along line 16-16 of FIG. 14, fastener assemblies 100, 100', 101, and 101' are fitted at gaps 92 and 252, and fastener assemblies 100 and 101 of blanket 41 are located between fastener assemblies 100' and 101' of blanket 210 at either side of central section 54 of blanket 54. In FIG. 16, fastener assembly 100' has two strips 110' and 111' of fabric tape that carry complementing rows 112' and 113' of metal or plastic teeth, and slider 114'. Row 112' of teeth may be referred to as an element or engagement element of fastener assembly 100', and row 113' of teeth may be referred to as a complementing element or complementing engagement element of fastener assembly 100'. The slider 114', operated by hand, moves along rows 112' and 113' of teeth and meshes together or separates rows 112' and 113' of teeth depending on the direction of movement. According to the invention, slider 114' meshes rows 112' and 113' of teeth together when moved in the direction indicated by the arrowed line A in FIG. 13 toward end 220 of blanket 210, and separates rows 112' and 113' of teeth when moved in the direction indicated by the arrowed line B in FIG. 13 toward end 221 of blanket 210. Fastener assembly 101' is a slide fastener assembly consisting of two strips 120' and 121' of fabric tape that carry complementing rows 122' and 123' of metal or plastic teeth, and slider 124'. Row 122' of teeth may be referred to as an element or engagement element of fastener assembly 101', and row 123' of teeth may be referred to as a complementing element or complementing engagement element of fastener assembly 101'. The slider 124', operated by hand, moves along rows 122' and 123' of teeth and meshes together or separates rows 122' and 123' of teeth depending on the direction of movement. According to the invention, slider 124' meshes rows 122' and 123' of teeth together when moved in the direction indicated by the arrowed line C in FIG. 13 toward end 220 of blanket 210, and separates rows 122' and 123' of teeth when moved in the direction indicated by the arrowed line D in FIG. 31 toward end 221 of blanket 210.

The strips of the corresponding fastener assemblies 100, 101, 100', and 101' are secured/affixed in place with stitching, heat bonding, adhesive, or the like. Strips 111 and 121 of fastener assemblies 100 and 101 are affixed to each other and also to central section 54 of blanket 40 between fastener assemblies 100' and 101'. Strip 110' of fastener assembly 100' is secured to and along marginal edge 250 of coverlet 225, and strip 111' of fastener assembly 100' is secured to and along central section 54 of blanket 40. Strip 120' of fastener assembly 101' is secured to and along marginal edge 251 of coverlet 226, and strip 121' of fastener assembly 101' is secured to and along central section 54 of blanket 40.

Referencing FIG. 13, the sliders 114' and 164', operated by hand, of fastener assembly 100' each moves along the rows of teeth of fastener assembly 100' and mesh together or separates the rows of teeth depending on the direction of movement. In the present embodiment, slider 114' meshes the rows of teeth together when moved in the direction indicated by arrowed line A in FIG. 14 toward end 220 of blanket 210, and separates the rows of teeth when moved in the direction indicated by the arrowed line B in FIG. 13 toward end 221 of blanket 210, whereas slider 164' of fastener assembly 100' meshes the rows of teeth together when moved in the direction indicated by arrowed line E in FIG. 13 toward end 221 of blanket 210, and separates the rows of teeth of fastener assembly 100' when moved in the direction indicated by the arrowed line F in FIG. 13 toward end 220 of blanket 210. The sliders 124' and 174', operated by hand, of slider assembly 101' each moves along the corresponding rows of teeth and meshes together or separates the rows of teeth of fastener assembly 101' depending on the direction of movement. According to the invention, slider 124' meshes the rows of teeth of fastener assembly 101' together when moved in the direction indicated by the arrowed line C in FIG. 13 toward end 220 of blanket 210, and separates the rows of teeth of fastener assembly 101' when moved in the direction indicated by the arrowed line D in FIG. 13 toward end 221 of blanket 210, whereas slider 174' meshes the rows of teeth of fastener assembly 101' together when moved in the direction indicated by arrowed line G in FIG. 13 toward end 221 of blanket 210, and separates rows the rows of teeth of fastener assembly 101' when moved in the direction indicated by the arrowed line H in FIG. 13 toward end 220 of blanket 210.

Fastener assemblies 100, 101, 100', and 101' of bedclothes apparatus 200 are operable independently of each other to provide independent operation and use of the corresponding coverlets. Fastener assembly 100' is operable to secure marginal edge 250 of coverlet 225 with respect to or otherwise to and along central section 54 of blanket 40 to allow coverlet 225 to be laid across segment 55 of blanket 40, and to release marginal edge 250 of coverlet 225 from central section 54 as shown in FIG. 17 by sliding slider 114' toward end 221 of blanket 210 away from end 220 of blanket 210 to allow coverlet 225 from end 220 to be peeled, folded, or otherwise moved away from segment 55 of blanket 40 and central section 54 of blanket 40 from end 50 of blanket 40, such as when an occupant lying on mattress 32 under segment 55 is too hot and wishes to uncover himself from coverlet 225 from end 50 of blanket 40. Likewise, fastener assembly 101' is independently operable to secure marginal edge 251 of coverlet 226 with respect to or otherwise to and along central section 54 of blanket 40 to allow coverlet 226 to be laid across segment 56 of blanket 40, and to release marginal edge 251 of coverlet 226 from central section 54 by sliding slider 124' toward end 221 of blanket 210 away from end 220 of blanket 210 to allow coverlet 226 from end 220 to be peeled, folded, or otherwise moved away from segment 56 of blanket 40 and central section 54 of blanket 40 at end 50 of blanket 40 in exactly the same manner as described and shown in connection with coverlet 225, such as when an occupant lying on mattress 32 under segment 56 is too hot and wishes to uncover himself from coverlet 226. Coverlet 225 can be secured and released with respect to central section 54 of blanket 40 in this way independent of and without disturbing coverlet 226 and coverlets 75 and 76, and coverlet 226 can be secured and released with respect to central section of blanket 40 in this way as may be desired with respect to and without disturbing coverlet 225 or coverlets 75 and 76.

Fastener assembly 100' is further operable to also release marginal edge 90 of coverlet 75 from central section 54 as shown in FIG. 18 by sliding slider 164' toward end 220 of blanket 210 away from end 221 of blanket 210 to allow coverlet 225 at end 221 to be peeled, folded, or otherwise moved away from segment 55 of blanket 40 and central section 54 of blanket 40 from end 51 of blanket 40, such as when an occupant lying on mattress 32 under segment 55 is too hot and wishes to uncover himself from coverlet 225 from end 50 of blanket 40. Because coverlet 225 is separate from coverlet 226, coverlet 225 can be arranged and moved in this way. Fastener assembly 101' is, likewise, operable to release marginal edge 251 of coverlet 226 from central section 54 by sliding slider 124' toward end 220 of blanket 210 away from end 221 of blanket 210 to allow coverlet 226 from end 221 thereof to be peeled, folded, or otherwise moved away from segment 56 of blanket 40 and central section 54 of blanket 40 from end 51 of blanket 40 in exactly the same manner as described and shown in connection with coverlet 225, such as when an occupant lying on mattress 32 under segment 56 is too hot and wishes to uncover himself from coverlet 226 from end 51 of blanket 40. Because coverlet 226 is separate from coverlet 225 and also coverlets 75 and 76, coverlet 226 can be arranged and moved in this way. Coverlet 225 can be secured and released with respect to central section 54 of blanket 40 in this way independent of and without disturbing coverlet 226 and coverlets 75 and 76, and coverlet 226 can be secured and released with respect to central section of blanket 40 in this way as may be desired with respect to and without disturbing coverlet 225 or coverlets 75 and 76.

In a further use and configuration of bedclothes apparatus 200, fastener assembly 100' is useful in completely detaching coverlet 225 from cover 40 as shown in FIG. 19, and fastener assembly 101' in bedclothes apparatus 200 is likewise useful in completely detaching coverlet 226 from cover 40. Coverlet 225 may be detached from cover 40 in two ways, including sliding slider 114' all the way from end 220 of blanket 210 to end 221 of blanket 210 to completely detach the rows of teeth of fastener assembly 100' to thereby completely detach marginal edge 250 of coverlet 225 from central section 54 of blanket 40, or by sliding slider 164' all the way from end 221 of blanket 210 to end 220 of blanket 210 to completely detach rows of teeth of fastener assembly 100' to thereby completely detach marginal edge 250 of coverlet 225 from central section 54 of blanket 40. Coverlet 225 may be so detached in the instance in which use of coverlet 225 by a user lying under segment 55 of blanket 40 is not desired without disturbing coverlet 226 attached in place and which remains attached in place when coverlet 225 is completely detached. Coverlet 225 may be reattached to central section 54 of blanket 40 simply by re-zipping the rows of teeth of fastener assembly 100' back together with either slider 114' or slider 164', which is simply the reverse of the operation used to detach coverlet 225 from blanket 40. Because coverlet 225 is separate from coverlet 226 and also coverlets 75 and 76, coverlet 75 can be arranged and moved in this way independent of coverlet 226 and also coverlets 75 and 75.

In bedclothes apparatus 200 it is to be understood that with both coverlets 225 and 226 in their secured positions, movement of either coverlet 225 or 226 from its secured position to its released position through the operation of its respective fastener assembly will not disturb the other one of coverlets 225 and 226 from its secured position, in accordance with the principle of the invention, and this is dictated by the structure of the respectively fastener assemblies 100' and 101' and their attachment to, and structural association with, blankets 40 and 210.

As with coverlet 225, coverlet 226 may be detached from cover 40 in two ways, including sliding slider 124' all the way from end 220 of blanket 210 to end 221 of blanket 210 to completely detach the rows of teeth of fastener assembly 101' to thereby completely detach marginal edge 251 of coverlet 226 from central section 54 of blanket 40, or by sliding slider 174' all the way from end 221 of blanket 210 to end 220 of blanket 210 to completely detach the rows of teeth of fastener assembly 101' to thereby completely detach marginal edge 251 of coverlet 226 from central section 54 of blanket 40. Coverlet 226 may be so detached in the instance in which use of coverlet 226 by a user lying under segment 56 of blanket 40 is not desired without disturbing coverlet 225 attached in place and which remains attached in place when coverlet 226 is completely detached. Coverlet 226 may be reattached to central section 54 of blanket 40 simply by re-zipping the rows of teeth of fastener assembly 101' back together with either slider 124' or slider 174', which is simply the reverse of the operation used to detach coverlet 226 from blanket 40. Because coverlet 226 is separate from coverlet 225 and also coverlets 75 and 76, coverlet 226 can be arranged and moved in this way independent of coverlets 225, 75, and 76. Because coverlets 225 and 226 can each be detached as described, they can each be easily washed independently of each other, and, moreover, independently of cover 40, such as in a washing machine or by hand if so desired.

It is to be emphasized that the fitted configuration of end 221 of blanket 210 in bedclothes apparatus 200 helps in the operation of fastener assemblies 100' and 101' by effectively securing blanket 210 in place with respect to mattress 32 and thus stabilizing blanket 210 as sliders 114' and 164' in conjunction with coverlet 225 and sliders 124' and 174' in conjunction with coverlet 226 are moved back and forth to secure and release coverlets 225 and 226 during use of bedclothes apparatus 200 as herein specifically described. In an alternate embodiment, blanket 210 can be unfitted and simply constructed as a broad, flat blanket as discussed in connection with bedclothes apparatus 30.

Fastener assembly 100 relates to coverlet 75, fastener assembly 101 relates to coverlet 76, fastener assembly 100' relates to coverlet 225, and fastener assembly 101' relates to coverlet 226, and each of said fastener assemblies are useful independently of each other for moving the various coverlets between their various positions as desired. With blanket 210 positioned between blanket 40 and blanket 41 and coverlets 225 and 226 in their secured positions and laid over segments 55 and 56, respectively, of blanket 40, blanket 41 is not only positioned atop blanket 40 but is also positioned atop blanket 210, in which coverlet 75 extends over and across coverlet 225 of blanket 210, and coverlet 76 extends over and across coverlet 226 of blanket 210. In this configuration, coverlets 75 and 76 may be used and moved between their various positions with respect to coverlets 225 and 226 as herein specifically described without disturbing coverlets 225 and 226 of blanket 210, and coverlets 225 and 226 may be similarly and adjusted independently of each other and also coverlets 75 and 76. And so with blanket 210 positioned between blanket 40 and blanket 41 and coverlets 225 and 226 in their secured positions and laid over segments 55 and 56, fastener assembly 100 of bedclothes apparatus 200 is operable to secure marginal edge 90 of coverlet 75 with respect to or otherwise to and along central section 54 of blanket 40 to allow coverlet 75 to be laid across coverlet 225, to release marginal edge 90 of coverlet 75 from central section 54 as shown in FIG. 17 by sliding slider 114 toward end 71 of blanket 41 away from end 70 of blanket 41 to allow coverlet 75 from end 70 to be peeled, folded, or otherwise moved away from coverlet 225 and central section 54 of blanket 40 from end 50 of blanket 40, to release marginal edge 90 of coverlet 75 from central section 54 as shown in FIG. 18 by sliding slider 164 toward end 70 of blanket 41 away from end 71 of blanket 41 to allow coverlet 75 from end 71 to be peeled, folded, or otherwise moved away from coverlet 225 and central section 54 of blanket 40 from end 51 of blanket 40, and to completely release coverlet 75 from blanket 40. Furthermore, with blanket 210 positioned between blanket 40 and blanket 41 and coverlets 225 and 226 in their secured positions and laid over segments 55 and 56, fastener assembly 101 of bedclothes apparatus 200 is operable to secure marginal edge 91 of coverlet 76 with respect to or otherwise to and along central section 54 of blanket 40 to allow coverlet 76 to be laid across coverlet 226, to release marginal edge 91 of coverlet 76 from central section 54 by sliding slider 124 toward end 71 of blanket 41 away from end 70 of blanket 41 to allow coverlet 76 from end 70 to be peeled, folded, or otherwise moved away from coverlet 226 and central section 54 of blanket 40 from end 50 of blanket 40, to release marginal edge 91 of coverlet 76 from central section 54 by sliding slider 174 toward end 70 of blanket 41 away from end 71 of blanket 41 to allow coverlet 76 from end 71 to be peeled, folded, or otherwise moved away from coverlet 225 and central section 54 of blanket 40 from end 51 of blanket 40, and to completely release coverlet 76 from blanket 40.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A bedclothes apparatus, comprising:

a blanket sized to cover two occupants of a bed, the blanket having a central section and opposed first and second segments formed on either side of the central section, the first and second segments having opposed first and second upper sections, respectively, and opposed first and second lower sections, respectively, wherein the central section extends along the first and second upper sections and the first and second lower sections of the first and second segments, respectively, of the blanket;

a first coverlet having a first marginal edge;

a first slide fastener assembly incorporating opposed first and second sliders, the first slide fastener assembly formed between the central section of the blanket and the first marginal edge of the first coverlet;

the first slide fastener assembly operable to secure the first marginal edge of the first coverlet to and along the central section of the blanket in a first secured condition of the first coverlet to allow the first coverlet to be laid across the first segment of the blanket, to release the first marginal edge of the first coverlet from the central section of the blanket in response to movement of the first slider in a direction from the first upper section of the first segment of the blanket toward the first lower section of the first segment of the blanket extending along the first upper section of the first segment of the blanket to allow the first coverlet to be moved away from the first upper section of the first segment of the blanket and the central section of the blanket extending along the first upper section of the first segment of the blanket while leaving the first marginal edge of the first coverlet secured to the central section of the blanket extending along the first lower section of the first segment of the blanket, and to release the first marginal edge of the first coverlet from the central section of the blanket in response to movement of the second slider in a direction from the first lower section of the first segment of the blanket toward the first upper section of the first segment of the blanket extending along the first lower section of the first segment of the blanket to allow the first coverlet to be moved away from the first lower section of the first segment of the blanket and the central section of the blanket extending along the first lower section of the first segment of the blanket while leaving the first marginal edge of the first coverlet secured to the central section of the blanket extending along the first upper section of the first segment of the blanket;

a second coverlet having a second marginal edge;

a second slide fastener assembly incorporating opposed third and fourth sliders, the second slide fastener assembly formed between the central section of the blanket and the second marginal edge of the second coverlet;

the second slide fastener assembly operable to secure the second marginal edge of the second coverlet to and along the central section of the blanket in a second secured condition of the second coverlet to allow the second coverlet to be laid across the first segment of the blanket and the first coverlet in the first secured condition of the first coverlet laid across the first segment of the blanket, to release the second marginal edge of the second coverlet from the central section of the blanket in response to movement of the third slider in a direction from the first upper section of the first segment of the blanket toward the first lower section of the first segment of the blanket extending along the first upper section of the first segment of the blanket to allow the second coverlet to be moved away from the first upper section of the first segment of the blanket and the central section of the blanket extending along the first upper section of the first segment of the blanket while leaving the second marginal edge of the second coverlet secured to the central section of the blanket extending along the first lower section of the first segment of the blanket, and to release the second marginal edge of the second coverlet from the central section of the blanket in response to movement of the fourth slider in a direction from the first lower section of the first segment of the blanket toward the first upper section of the first segment of the blanket extending along the first lower section of the first segment of the blanket to allow the second coverlet to be moved away from the first lower section of the first segment of the blanket and the central section of the blanket extending along the first lower section of the first segment of the blanket while leaving the second marginal edge of the second coverlet secured to the central section of the blanket extending along the first upper section of the first segment of the blanket;

the first coverlet having a first warmth characteristic; and the second coverlet having a second warmth characteristic different from the first warmth characteristic of the first coverlet.

2. The bedclothes apparatus according to claim 1, further comprising:

a third coverlet having a third marginal edge;

a third slide fastener assembly incorporating opposed fifth and sixth sliders, the third slide fastener assembly formed between the central section of the blanket and the third marginal edge of the third coverlet to releasably connect the third marginal edge of the third coverlet to the central section of the blanket;

the third slide fastener assembly operable to secure the third marginal edge of the third coverlet to and along the central section of the blanket in a third secured condition of the third coverlet to allow the third coverlet to be laid across the second segment of the blanket, to release the third marginal edge of the third coverlet from the central section of the blanket in response to movement of the fifth slider in a direction from the second upper section of the second segment of the blanket toward the second lower section of the second segment of the blanket extending along the second upper section of the second segment of the blanket to allow the third coverlet to be moved away from the second upper section of the second segment of the blanket and the central section of the blanket extending along the second upper section of the second segment of the blanket while leaving the third marginal edge of the third coverlet secured to the central section of the blanket extending along the second lower section of the second segment of the blanket, and to release the third marginal edge of the third coverlet from the central section of the blanket in response to movement of the sixth slider in a direction from the second lower section of the second segment of the blanket toward the second upper section of the second segment of the blanket extending along the second lower section of the second segment of the blanket to allow the third coverlet to be moved away from the second lower section of the second segment of the blanket and the central section of the blanket extending along the second lower section of the second segment of the blanket while leaving the third marginal edge of the third coverlet secured to the central section of the blanket extending along the second upper section of the second segment of the blanket.

3. The bedclothes apparatus according to claim 2, further comprising:

a fourth coverlet having a fourth marginal edge;

a fourth slide fastener assembly incorporating opposed seventh and eighth sliders, the fourth slide fastener assembly formed between the central section of the blanket and the fourth marginal edge of the fourth coverlet to releasably connect the fourth marginal edge of the fourth coverlet to the central section of the blanket;

the fourth slide fastener assembly operable to secure the fourth marginal edge of the fourth coverlet to and along the central section of the blanket in a fourth secured condition of the fourth coverlet to allow the fourth coverlet to be laid across the second segment of the blanket and the third coverlet in the third secured condition of the third coverlet laid across the second segment of the blanket, to release the fourth marginal edge of the fourth coverlet from the central section of the blanket in response to movement of the seventh slider in a direction from the second upper section of the second segment of the blanket toward the second lower section of the second segment of the blanket extending along the second upper section of the second segment of the blanket to allow the fourth coverlet to be moved away from the second upper section of the second segment of the blanket and the central section of the blanket extending along the second upper section of the second segment of the blanket while leaving the fourth marginal edge of the fourth coverlet secured to the central section of the blanket extending along the second lower section of the second segment of the blanket, and to release the fourth marginal edge of the fourth coverlet from the central section of the blanket in response to movement of the eighth slider in a direction from the second lower section of the second segment of the blanket toward the second upper section of the second segment of the blanket extending along the second lower section of the second segment of the blanket to allow the fourth coverlet to be moved away from the second lower section of the second segment of the blanket and the central section of the blanket extending along the second lower section of the second segment of the blanket while leaving the fourth marginal edge of the fourth coverlet secured to the central section of the blanket extending along the second upper section of the second segment of the blanket.

4. The bedclothes apparatus according to claim 3, further comprising:

the third coverlet having a third warmth characteristic; and the fourth coverlet having a fourth warmth characteristic different from the third warmth characteristic of the third coverlet.

5. The bedclothes apparatus according to claim 4, wherein the first slide fastener assembly is further operable to release the first marginal edge of the first coverlet from the central section of the blanket to detach the first coverlet from the blanket.

6. The bedclothes apparatus according to claim 5, wherein the second slide fastener assembly is further operable to release the second marginal edge of the second coverlet from the central section of the blanket to detach the second coverlet from the blanket.

7. The bedclothes apparatus according to claim 6, wherein the third slide fastener assembly is further operable to release the third marginal edge of the third coverlet from the central section of the blanket to detach the third coverlet from the blanket.

8. The bedclothes apparatus according to claim 7, wherein the fourth slide fastener assembly is further operable to release the fourth marginal edge of the fourth coverlet from the central section of the blanket to detach the fourth coverlet from the blanket.

9. A bedclothes apparatus, comprising:

a blanket having opposed first and second sides;

a first coverlet having opposed first and second ends;

a second coverlet having opposed third and fourth ends;

a first slide fastener assembly incorporating opposed first and second sliders, the first slide fastener assembly formed between the blanket and the first coverlet;

a second slide fastener assembly incorporating opposed third and fourth sliders, the second slide fastener assembly formed between the blanket and the second coverlet;

the first slide fastener assembly operable to secure the first coverlet to the blanket in a first secured condition of the first coverlet to allow the first coverlet to be laid across the first side of the blanket, to release the first coverlet from the blanket in response to movement of the first slider in a direction from the first end of the first coverlet to the second end of the first coverlet to allow the first end of the first coverlet to be moved away from the blanket while leaving the second end of the first coverlet secured to the blanket, and to release the first coverlet from the blanket in response to movement of the second slider in a direction from the second end of the first coverlet to the first end of the first coverlet to allow the second end of the first coverlet to be moved away from the blanket while leaving the first end of the first coverlet secured to the blanket;

the second slide fastener assembly operable to secure the second coverlet to the blanket in a second secured condition of the second coverlet to allow the second coverlet to be laid across the first side of the blanket and the first coverlet in the first secured condition of the first coverlet laid across the first side of the blanket, to release the second coverlet from the blanket in response to movement of the third slider in a direction from the third end of the second coverlet to the fourth end of the second coverlet to allow the third end of the second coverlet to be moved away from the blanket while leaving the fourth end of the second coverlet secured to the blanket, and to release the second coverlet from the blanket in response to movement of the fourth slider in a direction from the fourth end of the second coverlet to the third end of the second coverlet to allow the fourth end of the second coverlet to be moved away from the blanket while leaving the third end of the second coverlet secured to the blanket;

the first coverlet having a first warmth characteristic; and the second coverlet having a second warmth characteristic different from the first warmth characteristic of the first coverlet.

10. The bedclothes apparatus according to claim 9, further comprising:

a third coverlet having opposed fifth and sixth ends;

a fourth coverlet having opposed seventh and eighth ends;

a third slide fastener assembly incorporating opposed fifth and sixth sliders, the third slide fastener assembly formed between the blanket and the third coverlet;

a fourth slide fastener assembly incorporating opposed seventh and eighth sliders, the fourth slide fastener assembly formed between the blanket and the fourth coverlet;

the third slide fastener assembly operable to secure the third coverlet to the blanket in a third secured condition of the third coverlet to allow the third coverlet to be laid across the second side of the blanket, to release the third coverlet from the blanket in response to movement of the fifth slider in a direction from the fifth end of the third coverlet to the sixth end of the third coverlet to allow the fifth end of the third coverlet to be moved away from the blanket while leaving the sixth end of the third coverlet secured to the blanket, and to release the third coverlet from the blanket in response to movement of the sixth slider in a direction from the sixth end of the third coverlet to the fifth end of the third coverlet to allow the sixth end of the third coverlet to be moved away from the blanket while leaving the fifth end of the third coverlet secured to the blanket;

the fourth slide fastener assembly operable to secure the fourth coverlet to the blanket in a fourth secured condition of the fourth coverlet to allow the fourth coverlet to be laid across the second side of the blanket and the third coverlet in the third secured condition of the third coverlet laid across the second side of the blanket, to release the fourth coverlet from the blanket in response to movement of the seventh slider in a direction from the seventh end of the fourth coverlet to the eighth end of the fourth coverlet to allow the seventh end of the fourth coverlet to be moved away from the blanket while leaving the eighth end of the fourth coverlet secured to the blanket, and to release the fourth coverlet from the blanket in response to movement of the eighth slider in a direction from the eighth end of the fourth coverlet to the seventh end of the fourth coverlet to allow the eighth end of the fourth coverlet to be moved away from the blanket while leaving the seventh end of the fourth coverlet secured to the blanket;

the third coverlet having a third warmth characteristic; and the fourth coverlet having a fourth warmth characteristic different from the third warmth characteristic of the third coverlet.

11. The bedclothes apparatus according to claim 10, wherein the first slide fastener assembly is further operable to release the first coverlet from the blanket to detach the first coverlet from the blanket.

12. The bedclothes apparatus according to claim 10, wherein the second slide fastener assembly is further operable to release the second coverlet from the blanket to detach the second coverlet from the blanket.

13. The bedclothes apparatus according to claim 10, wherein the third slide fastener assembly is further operable to release the third coverlet from the blanket to detach the third coverlet from the blanket.

14. The bedclothes apparatus according to claim 10, wherein the fourth slide fastener assembly is further operable to release the fourth coverlet from the blanket to detach the fourth coverlet from the blanket.

* * * * *